US007390603B2

(12) United States Patent
Miyakawa et al.

(10) Patent No.: US 7,390,603 B2
(45) Date of Patent: Jun. 24, 2008

(54) IMAGE FORMING APPARATUS AND TONER

(75) Inventors: Nobuhiro Miyakawa, Nagano (JP); Toshiaki Yamagami, Nagano (JP); Satoshi Chiba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 405 days.

(21) Appl. No.: 11/166,052

(22) Filed: Jun. 24, 2005

(65) Prior Publication Data

US 2005/0287457 A1 Dec. 29, 2005

(30) Foreign Application Priority Data

Jun. 28, 2004 (JP) ..... P.2004-189615

(51) Int. Cl.
*G03G 9/00* (2006.01)

(52) U.S. Cl. ..... 430/108.3; 430/108.6; 430/111.4; 430/111.41; 399/252

(58) Field of Classification Search ..... 430/108.3, 430/108.6, 111.4, 111.41; 399/252
See application file for complete search history.

(56) References Cited

U.S. PATENT DOCUMENTS

2003/0095814 A1* 5/2003 Miyakawa et al. ..... 399/252

FOREIGN PATENT DOCUMENTS

| | | |
|---|---|---|
| JP | 63-304002 | 12/1988 |
| JP | 05-053482 | 3/1993 |
| JP | 08-146652 | 6/1996 |
| JP | 10-240004 | 9/1998 |
| JP | 11-249452 | 9/1999 |
| JP | 2000-019746 | 1/2000 |
| JP | 2000-075541 | 3/2000 |
| JP | 2000-128534 | 5/2000 |
| JP | 2003-107770 | 4/2003 |
| JP | 2004-037899 | 2/2004 |
| JP | 2004-093580 | 3/2004 |

* cited by examiner

*Primary Examiner*—Mark A Chapman
(74) *Attorney, Agent, or Firm*—Hogan & Hartson LLP

(57) ABSTRACT

The present invention provides An image forming apparatus having: a negatively chargeable spherical toner; an latent image carrier; a charging member for charging a surface of the latent image carrier uniformly without contacting the latent image carrier; an electrostatic latent image forming member for forming an electrostatic latent image on the surface of the latent image carrier; a developing member for developing the electrostatic latent image, without contacting the latent image carrier, by using the negatively chargeable spherical toner so as to form a toner image on the latent image carrier; and an intermediate transfer medium to which the toner image is transferred, wherein the negatively chargeable spherical toner haves: a toner mother particle having a binder resin and a colorant; and a hydrophobic alumina particle as an external additive, wherein the hydrophobic alumina particle has a work function ($\Phi_{A1}$) larger than a work function ($\Phi_{TM}$) of a surface of the intermediate transfer medium.

16 Claims, 6 Drawing Sheets

IMAGE FORMING APPARATUS AND TONER

FIELD OF THE INVENTION

The present invention relates to an image forming apparatus forming an image, using the electrophotographic method, by a cleanerless method.

BACKGROUND OF THE INVENTION

In the electrophotographic method, after developing an electrostatic latent image formed on a latent image carrier provided with a photoconductive substance using toner particles containing a colorant, the electrostatic latent image is transferred on an intermediate transfer medium, and then the thus-obtained toner image is transferred on a recording material such as a paper to be fixed by heat, pressure, and the like, thereby forming a copy or a printed material. Since the toner remaining on the latent image carrier after the transfer process can be the cause of unwanted reverse printing and photographic fogging on the recording material in an electrophotographic process which is a post process, a cleaning member is used for removing the residual toner on the latent image carrier.

A so-called blade cleaning method of scraping the residual toner by abutting a urethane blade or the like to the latent image carrier after the transfer process is widely used for the cleaning member. However, since the cleaning member employing the blade cleaning method causes a film of the latent image carrier to be shaved, such cleaning member has a problem of reduced latent image carrier life. Also, since the shaved film of the latent image carrier is subject to a fluctuation in electrostatic capacity of the latent image carrier, a fluctuation in image forming condition in the electrophotographic method is caused to raise a problem of a deterioration of image quality. Further, since the cleaning member occupies a space around the latent image carrier for its installation, the cleaning member is not satisfactory for coping with downsizing of the latent image carrier which has recently been of an increased demand.

Accordingly, the image forming apparatus of the cleanerless method based on a so-called simultaneous development and cleaning, which is capable of collecting the toner left after the transfer into a developer by setting a potential difference during the development, has been proposed (References 1 to 3). Though the image forming apparatus of cleanerless method is downsized, since the residual toner, contaminants, and paper dust on the latent image carrier are collected in the image forming apparatus, problems of instable charging characteristics of developing agent, mixing of colors due to a reduction in transfer efficiency, a generation of fogging, and reverse transfer toner, and an insufficient color reproducibility have been raised.

A corona charger, for instance, is used for uniformly charging a surface of the latent image carrier, and such corona charger is subject to discharge product such as NOx and ozone due to its discharge. NOx reacts with moisture in the air or the like to be nitric acid or reacts with metals to generate a nitrate salt. The acid and salt has a property of depositing on the surface of the latent image charier in the form of a thin film and reduces a resistance of the latent image carrier surface to cause disturbances in electrostatic latent image to be formed on the latent image carrier surface, which results in disturbed image. Therefore, Reference 3 discloses the use of a contact member of a development roller, a transfer roller, or the like of a developer as a polishing member, but such usage raises a problem of abrasion deterioration of the latent image carrier.

Also, in Reference 4, the disturbance in electrostatic latent image on the latent image carrier surface is suppressed by preventing influences by moisture in the air by blowing dehumidified air around the latent image carrier, but this does not solve the problem caused by the collection of the residual toner, the contaminants, and the paper dust on the latent image carrier into the developer in the simultaneous developing and cleaning.

Also, a method of cleaning in the intermediate transfer medium by: using a spherical toner for the purpose of a high transfer efficiency; setting a sphericity of the toner to 0.96 or more; and collecting the residual toner on the latent image carrier followed by removing the residual toner to the intermediate transfer medium (Reference 5) have been proposed, but this method is problematic from the viewpoint of downsizing of the latent image carrier though this method is capable of preventing the color mixing of toners thanks to the use of a retention roller.

In Reference 6, the simultaneous development and cleaning by using a spherical toner having a sphericity of 0.950 to 0.995 in combination with a magnetic brush development is performed, but this method has the above-described problem caused by the collection of the residual toner, the contaminants, and the paper dust on the latent image carrier to the developer.

The inventors of this invention have proved that it is possible to reduce the fogging and to improve the transfer efficiency by setting a work function of the toner to a value larger than those of the latent image carrier and the intermediate transfer medium (Reference 7), but the improvement in transfer efficiency was about 96% and insufficient for realizing the cleanerless method which requires a transfer efficiency of 99% or more. The method did not consider the application thereof to the cleanerless method.

As described in the foregoing, the conventional cleanerless methods do not meet the conflicting demands of downsizing by the use of the cleanerless method and prevention of filming on the latent image carrier surface.

[Reference 1] JP 5-53482 A
[Reference 2] JP 8-146652 A
[Reference 3] JP 10-240004 A
[Reference 4] JP 2004-37899 A
[Reference 5] JP 11-249452 A
[Reference 6] JP 2000-75541 A
[Reference 7] JP 2003-107770 A An object of this invention is to provide an image forming apparatus of a cleanerless method wherein a member to be brought into contact with a latent image carrier is merely an intermediate transfer medium, the image forming apparatus being downsized and capable of reducing deposit on a surface of the latent image carrier.

SUMMARY OF THE INVENTION

The present inventors have made eager investigation to examine the problem. As a result, it has been found that the foregoing objects can be achieved by the following image forming apparatus and toner. With this finding, the present invention is accomplished.

The present invention is mainly directed to the following items:

(1) An image forming apparatus comprising: a negatively chargeable spherical toner; an latent image carrier; a charging member for charging a surface of the latent image carrier uniformly without contacting the latent image carrier; an electrostatic latent image forming member for forming an electrostatic latent image on the surface of the latent image carrier; a developing member for developing the electrostatic latent image, without contacting the latent image carrier, by using the negatively chargeable spherical toner so as to form a toner image on the latent image carrier; and an intermediate transfer medium to which the toner image is transferred, wherein the negatively chargeable spherical toner comprises: a toner mother particle comprising a binder resin and a colorant; and a hydrophobic alumina particle as an external additive, wherein the hydrophobic alumina particle has a work function ($\Phi_{A1}$) larger than a work function ($\Phi_{TM}$) of a surface of the intermediate transfer medium.

(2) The image forming apparatus according to item 1, wherein the hydrophobic alumina particle is subjected to a silicon oil treatment.

(3) The image forming apparatus according to item 2, wherein the silicon oil treatment is subjected by a ratio of 0.1 to 10% by weight.

(4) The image forming apparatus according to item 1, wherein the work function ($\Phi_{A1}$) of the hydrophobic alumina particle is from 5.1 to 5.7 eV and the work function ($\Phi_{TM}$) of the surface of the intermediate transfer medium is from 4.9 to 5.5 eV, and the difference between the work function of the hydrophobic alumina particle and that of the surface of the intermediate transfer medium is at least 0.2 eV.

(5) The image forming apparatus according to item 1, wherein the intermediate transfer medium is an electronic conductive intermediate transfer belt.

(6) The image forming apparatus according to item 5, wherein the intermediate transfer belt has a circumferential speed of 1.0 to 2.5 times as large as that of the latent image carrier.

(7) The image forming apparatus according to item 1, wherein a work function ($\Phi_t$) of the negatively chargeable spherical toner, a work function ($\Phi_{OPC}$) of the surface of the latent image carrier, and the work function ($\Phi_{TM}$) of the surface of the intermediate transfer medium satisfy a relationship of $\Phi_t > \Phi_{OPC} > \Phi_{TM}$.

(8) The image forming apparatus according to item 7, wherein the work function ($\Phi_t$) of the negatively chargeable spherical toner is from 5.4 to 5.9 eV, the work function ($\Phi_{OPC}$) of the surface of the latent image carrier is from 5.2 to 5.6 eV, and the work function ($\Phi_{TM}$) of the surface of the intermediate transfer medium is from 4.9 to 5.5 eV, wherein the difference between the work function of the negatively chargeable spherical toner and that of the surface of the latent image carrier is at least 0.2 eV, and the difference between the work function of the surface of the latent image carrier and that of the surface of the intermediate transfer medium is at least 0.2 eV.

(9) The image forming apparatus according to item 1, wherein a sphericity of the negatively chargeable spherical toner is from 0.96 to 0.99 as a sphericity measured by a flow type particle image analyzer.

(10) The image forming apparatus according to item 1, wherein the negatively chargeable spherical toner is a monocomponent nonmagnetic toner formed by the solution suspension method.

(11) A negatively chargeable spherical toner comprising: a toner mother particle comprising a binder resin and a colorant; and a hydrophobic alumina particle as an external additive, wherein the hydrophobic alumina particle has a work function larger than a work function of a surface of the intermediate transfer medium.

(12) The negatively chargeable spherical toner according to item 11, wherein the hydrophobic alumina particle is subjected to a silicon oil treatment.

(13) The negatively chargeable spherical toner according to item 12, wherein the silicon oil treatment is subjected by a ratio of 0.1 to 10% by weight.

(14) The negatively chargeable spherical toner according to item 11, wherein the work function of the hydrophobic alumina particle is from 5.1 to 5.7 eV.

(15) The negatively chargeable spherical toner according to item 11, wherein a sphericity of the negatively chargeable spherical toner is from 0.96 to 0.99 as a sphericity measured by a flow type particle image analyzer.

(16) The negatively chargeable spherical toner according to item 11, wherein the negatively chargeable spherical toner is a monocomponent nonmagnetic toner formed by the solution suspension method.

BRIEF DESCRIPTION OF THE DRAWINGS

FIGS. 4A and 4B are drawings showing measurement cell to be used for measuring a work function of the toner, wherein FIG. 4A is a front view of the cell, and FIG. 4B is a side view of the cell.

FIGS. 5A and 5B are drawings for illustrating a method for measuring work functions of the image forming apparatus members having a cylindrical shape, wherein FIG. 5A is a perspective view showing a shape of a measurement piece, and FIG. 5B is a drawing showing a state of the measurement.

DETAILED DESCRIPTION OF THE INVENTION

The inventors of this invention have found that an image forming apparatus of a cleanerless method, wherein a member to be brought into contact with a latent image carrier is merely an intermediate transfer medium, is capable of transferring or moving deposits on a surface of the latent image carrier onto an intermediate belt and preventing filming by the deposits on latent image carrier by: increasing a transfer efficiency of a toner; using a hydrophobic alumina particle as an external additive (hereinafter referred to as "hydrophobic alumina externally added particle") to the toner; and setting a work function ($\Phi_{A1}$) of the hydrophobic alumina externally added particles to a value larger than a work function ($\Phi_{TM}$) of the intermediate medium in the image forming apparatus even if released hydrophobic alumina particles show a weak positive charge character in a negatively chargeable toner.

Figure 1:
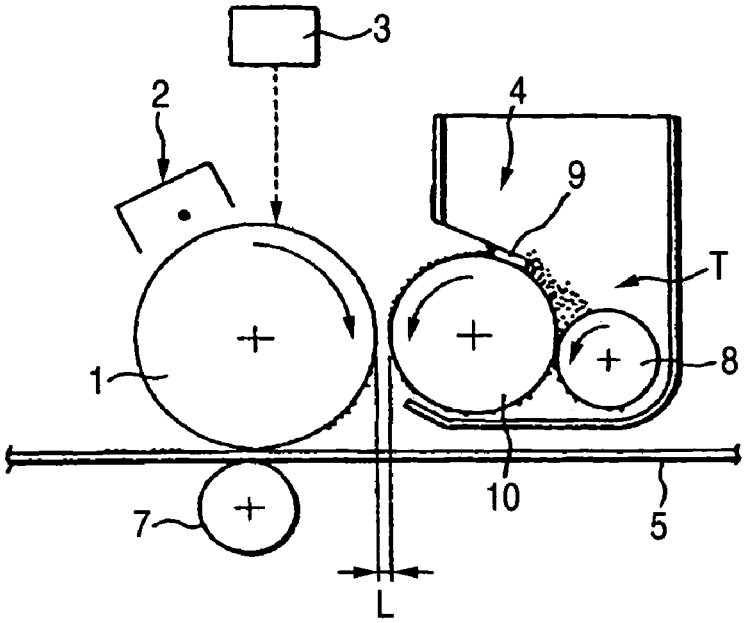
FIG. 1 is a drawing showing a contact less developing method in an image forming apparatus of this invention.

FIG. 1 is a drawing for illustrating a developer in an image forming apparatus of this invention. A latent image carrier 1 is provided with a charging member 2, an exposure member 3, a developing member 4, and an intermediate transfer medium 5. The latent image carrier 1 is brought into contact only with the intermediate transfer medium 5 and is not provided with any cleaning blade to realize the cleanerless latent image carrier. In FIG. 1, a backup roller 7, a toner supply roller 8, a toner regulation blade (toner layer thickness regulating member) 9, a development roller, a monocomponent nonmagnetic toner T, and a development gap L are also shown. Hereinafter, a case of a monocomponent development method will be described mainly, but this invention is applicable to a two-component development method.

The latent image carrier 1 is a photoreceptor drum having a diameter of 24 to 86 mm and rotating at a surface speed of 60 to 300 mm/s. A surface of the latent image carrier 1 is negatively charged uniformly by a corona charger 2, and then exposure 3 corresponding to information to be recorded is performed to form a latent image.

The latent image carrier is preferably an organic single layer type or an organic multilayer type, and the one obtained by forming an underlayer, a charge generation layer, and a charge transport layer on an electroconductive support in this order is preferably used as the organic multilayer type photoreceptor.

Any general electroconductive support can be used as the electroconductive support, and examples thereof are an electroconductive support having electroconductivity of a volume resistance of $10^{10}$ Ω·cm or less such as a tubular support having the size of 20 to 90 mmϕ obtainable by processing (cutting, etc.) an aluminum alloy; an electroconductive support obtainable by imparting the electroconductivity by performing aluminum vapor deposition or electroconductive coating on a polyethylene telephthalate film; tubular, belt-like, plate-like, and sheet like supports each obtained by molding a electroconductive polyimide resin and having the size of 20 to 90 mmϕ, and the like. Other examples of the suitable electroconductive support are a metal belt such as a seamless nickel electroformed tube and a seamless stainless tube.

Any general underlayer can be used as the underlayer to be provided on the electroconductive support. For instance, the underlayer is provided for the purposes of enhancing adhesiveness, preventing moire, improving coating property of the charge generation layer to be provided as an upper layer, reducing a residual potential at the exposure, and the like. A resin to be used for the underlayer may preferably be that having a high insolubility to a solvent used for the photosensitive layer since the photosensitive layer is applied on the resin. Examples of usable resin are a water soluble resin such as polyvinyl alcohol, casein, and sodium polyacrylate; a alcohol soluble resin such as vinyl acetate, a copolymerized nylon, and a methoxymethylated nylon; polyurethane; a melamine resin; an epoxy resin; and the like, and these resins can be used alone or in combination of two or more. Also, a metal oxide such as titanium oxide and zinc oxide can be contained in the resin.

Any general material as a charge generation pigment can be used as a charge generation pigment in the charge generation layer. Examples of the charge generation pigment are a phthalocyanine based pigment such as metal phthalocyanine and metal free phthalocyanine; an azulenium salt pigment; a squaric acid methine pigment; an azo pigment having a carbazole skeleton; an azo pigment having a triphenylamine skeleton; an azo pigment having a diphenylamine skeleton; an azo pigment having a dibenzothiophene skeleton; an azo pigment having a fluorene skeleton; an azo pigment having an oxadiazole skeleton; an azo pigment having a bisstilbene skeleton; an azo pigment having a distyryl oxadiazole skeleton; an azo pigment having a distyryl carbazole skeleton; a perylene based pigment; an anthraquinone based or polycyclic quinone based pigment; a quinoneimine based pigment; a diphenylmethane based pigment; an azomechine based pigment; a benzoquinone and naphthoquinone based pigment; a cyanine and azomechine based pigment; an indigoid based pigment; a bisbenzimidazol based pigment; and the like. These charge generation pigments can be used alone or in combination of two or more.

Examples of a binder resin in the charge generation layer are a polyvinyl butyral resin, a partially acetalated polyvinyl butyral resin, a polyarylate resin, a polyvinyl chloride-vinyl acetate copolymer, and the like. A proportion of the charge generation substance with respect to 100 parts of the binder resin is preferably in the range of 10 to 1,000 parts, by weight ratio.

Any general charge transport substance can be used for the charge transport layer, and electron transport substances and hole transport substances are included in the charge transport substances. Examples of the electron transport substances are electron accepting substances such as chloranyl, tetracyanoethylene, tetracyanoquinodimethane, 2,4,7-trinitro-9-fluorenone, a para-diphenoquinone derivative, a benzoquione derivative, and a naphthoquinone derivative. These electron transport substances can be used alone or in combination of two or more.

Examples of the hole transport substances are an oxazole compound, an oxadiazole compound, an imidazole compound, a triphenylamine compound, a pirazoline compound, a hydrazone compound, a stilbene compound, a phenazine compound, a benzofuran compound, a butadiene compound, a benzidine compound, and derivatives of these compounds. These electron donating substances can be used alone or in combination of two or more. An antioxidant, an anti-aging agent, an ultraviolet rays absorber, and the like can be contained in the electron transport layer in order to prevent deterioration of the above substances.

As a binder resin in the electron transport layer, polyester, polycarbonate, polysulfone, polyarylate, polyvinyl butyral, polymethylmethacrylate, a polyvinyl chloride resin, a polyvinyl-vinyl acetate copolymer, a silicone resin, and the like can be used, and polycarbonate is preferred in view of compatibility with the charge transport substance, film strength, a solubility, and a stability as a coating material. A ratio of the charge transport substance with respect to 100 parts of the binder resin is preferably in the range of 25 to 300 parts in weight ratio.

A coating liquid may suitably be used for forming the charge generation layer and the charge transport layer, and examples of a usable solvent are, though the type of a solvent to be used varies depending on the type of the binder resin, alcohols such as methanol, ethanol, and isopropylalcohol; ketones such as acetone, methylethylketone, and cyclohexanone; amides such as N,N-dimethylformamide and N,N-dimethylacetoamide; ethers such as hydrofuran, dioxane, and ethyleneglycol monomethylether; esters such as methyl acetate and ethyl acetate; aliphatic halogenated hydrocarbon such as chloroform, methylene chloride, dichlorethylene, carbon tetrachloride, and trichlorethylene; and aromatic series such as benzene, toluene, xylene, and monochlorbenzene; and the like.

It is preferable to disperse and mix the charge generation pigment by employing a method wherein a machine such as a sand mill, a ball mill, an atriter, and a planetary mill is used for dispersion and mixing.

As a coating method for the underlayer, the charge generation layer, and the charge transport layer, an immersion coating method, a ring coating method, a spray coating method, a wire bar coating method, spin coating, a blade coating method, a roller coating method, an air knife coating method, and the like can be employed. It is preferable to perform drying after the coating process by way of drying at an ordinary temperature and drying by heating at 30 to 200° C. for 30 to 120 minutes. A film thickness of the charge generation layer after the drying is preferably in the range of 0.05 to 10 μm, more preferably of 0.1 to 3 μm. A film thickness of the charge transport layer after the drying is preferably in the range of 5 to 50 μm, more preferably of 10 to 40 μm.

A single layer organic photoreceptor layer is formed by coating the single layer organic photoreceptor layer containing a charge generation agent, a charge transport agent, a sensitizer, a binder, a solvent, and the like on the electroconductive support described in the foregoing in conjunction with the organic multilayer type photoreceptor via the above-described under layer. An organic negatively charged single layer photoreceptor can be prepared in accordance with JP 2000-19746 A, for example.

Examples of the charge generation agent in the single layer organic photosensitive layer are a phthalocyanine based pigment, an azo based pigment, a quinone based pigment, a perylene based pigment, a quinocyaton based pigment, an indigo based pigment, a bisbenzimidazol based pigment, and a quinacridone based pigment, and a preferable charge generation agent is the phthalocyanine based pigment and the azo based pigment. Examples of the charge transport agent are hydrazone based, stilbene based, phenylamine based, arylamine based, diphenylbutadiene based, and oxazole based organic hole transport compounds. Examples of the sensitizer are paradiphenoquinone derivatives, naphthoquinone derivatives, chloranyl and the like, which are electron attracting organic compounds known also as electron transport agent. Examples of the binder are thermoplastic resins such as polycarbonate resins, polyarylate resins, and polyester resins.

Relative proportions of the components are as follows. A ratio of the binder is preferably from 40 to 75% by weight (hereinafter referred to as "wt %"), a ratio of the charge generation agent is preferably from 0.5 to 20 wt %, a ratio of the charge transport agent is preferably from 10 to 50 wt %, and a ratio of the sensitizer is preferably from 0.5 to 30 wt %. More preferably, the binder ratio is preferably from 45 to 65 wt %, the charge generation agent ratio is preferably from 1 to 20 wt %, the charge transport agent ratio is preferably from 20 to 40 wt %, and the sensitizer ratio is preferably from 2 to 25 wt %. As a solvent, those which do not have solubility are preferred, and examples thereof are toluene, methylethylketone, tetrahydrofurane, and the like.

Each of the components is subjected to pulverization, dispersion, and mixing by the use of a homomixer, a ball mill, a sand mill, an atriter, a paint conditioner, or the like to give the coating liquid. The coating liquid is applied on the underlayer by dip coating, ring coating, spray coating, or the like to be the single layer organic photoreceptor layer having a film thickness after drying preferably of from 15 to 40 μm, more preferably 20 to 35 μm.

The developer serves to reverse and develops an electrostatic latent image on the static image carrier in a contactless manner to obtain a visible image. A monocomponent non-magnetic toner T is housed in the developer, which is supplied to the development roller 10 by way of the supply roller 8 rotating in an anticlockwise direction as shown in FIG. 1. The development roller rotates in the anticlockwise direction as shown in FIG. 1 to convey the toner T conveyed thereto by the supply roller 8 to a portion opposed to the latent image carrier in a state where the toner T is absorbed on a surface thereof, thereby giving an visible image of an electrostatic latent image on the latent image carrier 1.

As the development roller, a roller obtained by plating or blasting a surface of a metal pipe having a diameter of 16 to 24 mm or a roller having an electroconductive resilient layer being made from NBR, SBR, EPDM, a urethane rubber, a silicon rubber, or the like and having a volume resistance of $10^4$ to $10^8$ Ω·cm and a hardness o 40 to 70° (Asker A hardness), which is formed on a surface of a central axis, can be used. A development bias voltage is applied via a shaft of the pipe of the development roller and the central axis.

As the regulation blade 9, those obtained by sticking a rubber chip on SUS, phosphor bronze, a rubber plate, a metal thin plate, and the like are used, and a work function of the regulation blade 9 on a toner contact surface is preferably from 4.8 to 5.4 eV, the work function being less than that of the toner. The regulation blade is preferably pressed against the development roller with a linear pressure of 0.245 to 0.49 N/cm by a biasing member such as a spring (not shown) or by the use of a repulsive force as a resilient body to keep a toner thickness on the development roller to preferably from 10 to 30 μm, more preferably from 13 to 25 μm as well as to achieve a layer form of toner particles of preferably from 1.2 to 3 layers, more preferably from 1.5 to 2.5 layers. In addition, when the toner layer thickness is regulated to 2 layers or more (toner conveying amount: 0.5 mg/cm$^2$), the toner having smaller particle diameter in the toner particles passes without contacting the toner layer regulation member to be a positively chargeable toner which tends to be caught up in the toner layer after the regulation, thereby causing fogging and a reduction in transfer efficiency. A toner charge amount can be controlled by injecting a charge into the toner to be brought into contact with the blade by applying a voltage to the regulation blade 9.

The development roller 10 and the latent image carrier 1 are opposed to each other via the development gap L. The development gap is preferably from 100 to 350 μm. A development bias of a direct current voltage (DC) not shown is preferably from −20 to −500 V, and conditions for an alternating current voltage (AC) to be superimposed on the direct current voltage is preferably from 1.5 to 3.5 kHz, and a P-P voltage is preferably of from 1,000 to 1,800 V. A circumferential speed of the development roller rotating in the anticlockwise direction is preferably from 1.0 to 2.5, more preferably from 1.2 to 2.2 with respect to the latent image carrier rotating in a clockwise direction.

In the portion where the latent image carrier and the development roller are opposed to each other, the toner T vibrates between the development roller surface and the latent image carrier surface so that an electrostatic latent image is developed, and since the toner particles contacts the latent image carrier during the vibration of the toner 8 between the development roller surface and the latent image carrier surface, it is possible to change a positively chargeable toner into a negatively chargeable toner thanks to a relationship between work functions described later in this specification.

Then, the intermediate transfer medium 5 is conveyed to a position between the latent image carrier 1 and the backup roller (transfer roller) 7. The transfer roller brings the intermediate transfer medium into pressure contact with the latent image carrier, and a voltage having a polarity reverse to that of the negatively chargeable toner is applied as a transfer voltage. Even when a reverse charged toner is generated on the latent image carrier, it is possible to enhance the transfer efficiency by keeping the work function of the toner to a value larger than that of the intermediate transfer medium.

Examples of the intermediate transfer medium include a transfer drum and a transfer belt having electron-conductivity. The transfer medium of the transfer belt system can be divided into two types depending on the type of substrate to be used. One of the two types of the transfer belts has a transfer layer which is a surface layer formed on a film or a seamless belt made from a resin, and the other has a transfer layer which is a surface layer formed on a resilient base layer. Also, the transfer medium of the drum system can be divided into two types depending on the type of substrate to be used. One of the two types of the transfer drums has a transfer layer which is a resilient surface layer formed on a drum substrate made from a rigid material such as aluminum when the latent image carrier has an organic photosensitive layer on a drum made from a rigid material such as aluminum. The other has a transfer layer which is a surface layer formed directly on or via an electroconductive intermediate layer a drum substrate made from a rigid material such as aluminum when the latent image carrier has a support of a so-called resilient photoreceptor obtained by forming a photosensitive layer on a resilient support having the shape of a belt or made from a rubber.

As the substrate, any general electroconductive or insulated substrate can be used. In the case of the transfer belt, a volume resistance is preferably from $10^4$ to $10^{12}$ Ω·cm, more preferably from $10^6$ to $10^{11}$ Ω·cm. The transfer belt can be classified into two types depending on the type of the substrate to be used.

A material and a manufacturing method suitable for the film and seamless belt are such that a semiconductor film substrate having a thickness of 50 to 500 μm obtained by dispersing an electroconductive material such as an electroconductive carbon black, electroconductive titanium oxide, electroconductive tin oxide, and silica into an engineering plastic such as modified polyimide, thermoset polyimide, polycarbonate, an ethylene tetrafluoroethylene copolymer, polyvinylidene fluoride, and a nylon alloy is made into a seamless substrate by extrusion molding. Also, a seamless belt obtained by forming a fluorine coating having a preferable thickness of 5 to 50 μm on an outer surface of the substrate as a surface protection layer for reducing a surface energy and preventing the filming of toner is preferably used. As the coating method, an immersion coating method, a ring coating method, a spray coating method, and the like can be used. In order to prevent cracks and stretching on an edge of the transfer belt and meandering, a tape preferably having a film thickness of 80 μm and made from a PET film or a rib made from a urethane rubber is used.

When manufacturing the substrate from the film sheet, it is possible to achieve a belt-like shape by performing supersonic welding on edges. More specifically, by performing the supersonic welding after forming the electroconductive layer and the surface layer on the sheet film, it is possible to manufacture a transfer belt having a desired property. More specifically, in the case of using a polyethylene telephthalate film having a thickness of 60 to 150 μm as the insulating substrate, a transfer belt is obtained by performing aluminum vapor deposition on a surface of the insulating substrate, followed by coating the intermediate layer made from an electroconductive material such as carbon black and a resin, and then forming a semiconductor surface layer having a surface resistance higher than that of the intermediate electroconductive layer and made from a urethane resin, a fluorine resin, an electroconductive material, and fluorine based fine particles. In the case where it is possible to use a resistance layer which does not need much heat for drying after coating, it is possible to obtain the transfer belt by forming the resistance layer after performing the super sonic welding of the aluminum vapor deposition film.

A material and a manufacture method suitable for the resilient substrate such as a rubber, a semiconductor rubber belt preferably having a thickness of 0.8 to 2.0 mm obtained by dispersing the above-described electroconductive material into a silicon rubber, a urethane rubber, an NBR (nitrile rubber), an EPDM (ethylene propylene rubber), or the like by extrusion molding, followed by controlling a surface roughness to a desired value by the use of a sand paper, polisher, and the like. It is possible t use the resilient layer as it is, but it is possible to provide a surface protection layer in the manner as in the foregoing description.

In the case of the transfer drum, the volume resistance is preferably in the range of $10^4$ to $10^{12}$ Ω·cm, more preferably $10^7$ to $10^{11}$ Ω·cm. It is possible to manufacture the transfer drum by providing a resilient electroconductive interlayer on a metal cylinder made from aluminum or the like to obtain an electroconductive resilient substrate, and then forming a semiconductor surface protection layer having a thickness of from 5 to 50 μm by fluorine coating, for example, for the purposes of reducing a surface energy and preventing the filming of the toner.

The electroconductive resilient substrate can be manufactured by contact molding on an aluminum cylinder having a diameter of 90 to 180 mm an electroconductive rubber material obtained by mixing, kneading, and dispersing an electroconductive material such as a carbon black, electroconductive titanium oxide, electroconductive tin oxide, electroconductive silica to a rubber material such as a silicon rubber, a urethane rubber, an NBR (nitrile rubber), an EPDM (ethylene propylene rubber), a butadiene rubber, a styrene-butadiene rubber, an isoprene rubber, a chloroprene rubber, a butyl rubber, an epichlorohydrin rubber, a fluorine rubber, and adjusting a thickness after polishing to from 0.8 to 6 mm and the volume resistance to from $10^4$ o $10^{10}$ Ω·cm. Then, a semiconductor surface layer having a film thickness of about 15 to 40 μm made from a urethane resin, a fluorine resin, an electroconductive material, a fluorine based fine particles can be formed to give a transfer drum having a desired volume resistance of $10^7$ to $10^{11}$ Ω·cm. A surface roughness of the transfer drum is preferably 1 μmRa or less. Alternatively, the electroconductive resilient substrate manufactured in the above-described manner is covered with a semiconductor tube made from a fluorine resin or the like, and then causing the tube to shrink by heating to obtain a transfer drum having a desired surface layer and an electrical resistance.

A voltage of from +250 to +60 V is preferably applied to the electroconductive layer as a primary transfer voltage in the transfer drum or the transfer belt, and a voltage of from +400 to +2,800 V is preferably applied to the transfer material such as a paper in the case of a secondary transfer.

The transfer roller 7 has a multilayer structure wherein a resilient layer, an electroconductive layer, and a resistive surface layer are formed in this order on a circumferential surface of a metal shaft preferably having a diameter of 10 to 20 mm. The resistive surface layer is formed by using a resistive sheet obtained by dispersing an electroconductive fine particles of an electroconductive carbon into a resin such as a fluorine resin and a polyvinyl butyral or a rubber such as a polyurethane and excellent in flexibility. The resistive surface layer preferably has a smooth surface, a volume resistance of from $10^7$ to $10^{11}$ Ω·cm, more preferably from $10^8$ to $10^{10}$ Ω·cm, and a thickness of from 0.02 to 2 mm.

The electroconductive layer may preferably be selected from an electroconductive resin, a metal sheet, and an electroconductive adhesive obtainable by dispersing electroconductive fine particles of an electroconductive carbon or the like into a polyester resin or the like, which has a volume resistance of $10^5$ Ω·cm or less. It is desirable that the resilient layer is flexibly deformed when the transfer roller is pressed into contact with the latent image carrier and returns to its original shape when the pressure contact is released. The resilient layer is formed by using a resilient material such as a foamed rubber sponge. The resilient layer preferably has a continuous foam (continuous bubbles) structure or a closed cell structure, a rubber hardness (Asker C hardness) of from 30 to 80, and a film thickness of from 1 to 5 mm. It is possible to bring the latent image carrier into a close contact with the intermediate transfer medium with a relatively wide nip width thanks to the resilient modification of the transfer roller. A pressure load to be applied on the latent image carrier by the transfer roller is preferably from 0.245 to 0.588 N/cm, more preferably from 0.343 to 0.49 N/cm.

After the toner is transferred from the latent image carrier to the intermediate transfer medium, the static charge on the latent image carrier is eliminated by the use of an elimination lamp, and then the latent image carrier is reused.

Hereinafter, the monocomponent nonmagnetic toner to be used in the image forming apparatus of FIG. 1 will be described. As the monocomponent nonmagnetic toner, any one of toners obtainable by a pulverization method, a solution suspension method, and a copolymerization method is preferably used.

Examples of the toner obtained by the pulverization method are those obtained by: uniformly mixing a pigment, a release agent, a charge controlling agent with a resin binder by the use of a henschel mixer; melting and kneading the mixture by the use of a biaxial extruder; cooling the mixture; roughly pulverizing and finely pulverizing the mixture; classifying the mixture, and then externally adding a fluidity improver to the mixture.

Any general toner resin can be used as the binder resin, and examples thereof are styrene based resins such as polystyrene, poly-α-methylstyrene, chloropolystyrene, a styrene-chlorostyrene copolymer, a styrene-propylene copolymer, a styrene-butadiene copolymer, a styrene-polyvinyl chloride copolymer, a styrene-vinyl acetate copolymer, a styrene-maleic acid copolymer, a styrene-acrylic acid ester copolymer, a styrene-methacrylic acid ester copolymer, styrene-acrylic acid ester-methacrylic acid ester copolymer, styrene-α-chloracrylic acid methyl copolymer, a styrene-acrylonitrile-acrylic acid ester copolymer, and a styrene-vinylmethylether copolymer, and a homopolymer or a copolymer containing styrene or a styrene substitution, a polyester resin, an epoxy resin, a urethane modified epoxy resin, a silicone modified epoxy resin, a polyvinyl chloride resin, a rosin modified maleic acid resin, a phenyl resin, polyethylene, polypropylene, an ionomer resin, a polyurethane resin, a silicone resin, a ketone resin, an ethylene-ethylacrylate copolymer, a xylene resin, a polyvinyl butyral resin, a terpene resin, a phenol resin, an aliphatic or alicyclic hydrocarbon resin, and the like, which can be used alone or in combination of two or more. Particularly, in this invention, it is preferable to use the styrene-acrylic acid ester based resin, the styrene-methacrylic acid ester based resin, and the polyester resin. The binder resin preferably has a glass transition temperature of from 50° C. to 75° C. and a flow softening temperature of from 100° C. to 150° C.

Any general colorant for toner can be used as the colorant. Examples of the colorant are carbon black, lampblack, magnetite, titanium black, chromium yellow, cobalt blue, aniline blue, phthalocyanine blue, phthalocyanine green, hanza yellow G, rhodamine 6G, chalcoil blue, quinacridone, benzidine yellow, rose Bengal, malachite green lake, quinoline yellow, C. I. pigment red 48:1, C. I. pigment red 57:1, C. I. pigment red 122, C. I. pigment red 184, C. I. pigment yellow 12, C. I. pigment yellow 17, C. I. pigment yellow 97, C. I. pigment yellow 180, C. I. solvent yellow 162, C. I. pigment blue 5:1, C. I. pigment blue 15:3, and the like, which can be used alone or in combination.

Any general release agent for toner can be used as the release agent. Examples of the release agent are a paraffin wax, a micro wax, a microcrystalline wax, a cadelilla wax, a carnauba wax, a rice wax, a montan wax, a polyethylene wax, a polypropylene wax, an oxidized polyethylene wax, an oxidized polypropylene wax, and the like. Among others, the polyethylene wax, the polypropylene wax, a carnauba wax, and an ester wax may preferably be used.

Any general charge controlling agent for toner can be used as the charge controlling agent. Examples the charge controlling agent are oil black, oil black BY, Bontron S-22 (manufactured by Orient Chemical Industries, Ltd.), Bontron S-34 (manufactured by Orient Chemical Industries, Ltd.), salicylic acid metal complex E-81 (manufactured by Orient Chemical Industries, Ltd.), a thioindigo based pigment, a sulfonylamine derivative of a copper phthalocyanine, Spiron Black TRH (manufactured by Hodogaya Chemical Co., Ltd.), a calixarene based compound, an organic boron compound, a fluorine containing tetra-ammonium salt based compound, a monoazo metal complex, an aromatic hydroxylcarboxylic acid based metal complex, an aromatic dicarboxylic acid based metal complex, polysaccharides, and the like. Among others, colorless or white charge controlling agents are preferably used for color toners.

Relative proportions (weight) in the toner of the pulverization method are such that the ratio of the colorant is preferably from 0.5 to 15 parts, more preferably from 1 to 10 parts; the ratio of the releasing agent is preferably from 1 to 10 part, more preferably from 2.5 to 8 parts; and the ratio of the charge controlling agent is preferably from 0.1 to 7 parts, more preferably from 0.5 to 5 parts, with respect to 100 parts of the binder resin.

The toner of the pulverization method may preferably be subjected to conglobation for the purpose of improving the transfer efficiency. For the conglobation, it is possible to achieve a sphericity of 0.94 by using an apparatus capable of pulverizing a toner into relatively spherical shape, such as a turbo mill (product of Matsubo Corporation) known as a mechanical pulverizer, and it is possible to achieve a sphericity of 1.00 by treating the pulverized toner using a commercially available hot air conglobation apparatus surfusing system SFS-3 (product of Nippon Pneumatic Mfg. Co., Ltd.).

The toner by the solution suspension method is obtainable by, when forming emulsion oil droplets by injecting into an aqueous liquid containing a dispersion stabilizing agent and an emulsifier through fine pores of a porous glass an oily liquid obtained by dispersing and dissolving a component of a toner made from a thermoplastic resin into an organic solvent, vibrating the emulsion oil droplets to form emulsion fine particles corresponding to a toner particle size, and then removing the organic solvent from the thus-obtained emulsion fine particles.

Figure 2A:
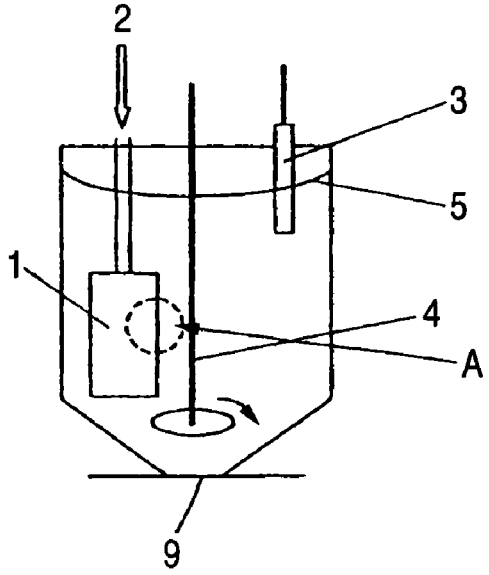
FIGS. 2A and 2B are schematic drawings of an apparatus used in a toner manufacturing method in this invention, wherein a main part is shown in FIG. 2A, and an enlarged sectional view of a part A in FIG. 2A is shown in FIG. 2B.
Figure 2B:
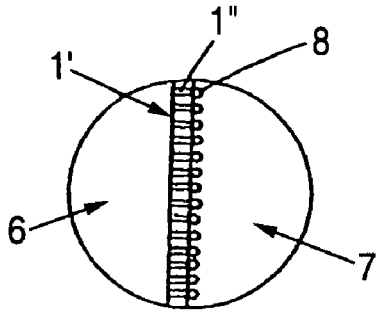

An outline of a manufacturing apparatus is shown in FIG. 2A, and an enlarged sectional view of a part A of the apparatus is shown in FIG. 2B. In the drawings, a cylindrical oily liquid injection member 1 having the porous glass 1' disposed on one side, a direction of introduction of the oily liquid 2, a supersonic element 3, a stirring blade 5, the oily liquid 6, the aqueous liquid 7, the emulsion oil droplets 8, and a container bottom 9 are shown.

As shown in FIGS. 2A and 2B, the porous glass (oily liquid injection member) is disposed in the container, and the oily liquid injected from above 2 the oily liquid injection member is injected into the aqueous liquid through the fine pores 1" of the porous glass 1' to be formed into the emulsion oil droplets corresponding to a toner particle size. In view of a oil droplet dragging phenomenon in the fine pore outlet of the porous glass, which results in formation of oil droplets having a too small diameter when the dragged portion is cut, it is possible to reduce the dragging phenomenon by vibrating the oil droplets 8 formed at a fine pore outlet (spout) in the porous glass, preferably by vibrating the oil droplets in a direction perpendicular to the direction of injecting the oily liquid into the aqueous liquid, in the formation process of the emulsion oil droplets at the time of injection of the oily liquid into the aqueous liquid, thereby obtaining a toner particles reduced in fine particle content and having a sharp particle distribution.

In order to vibrate the emulsion oil droplets at the fine pore outlet in the porous glass, the supersonic element 3 is disposed in the aqueous liquid disposed above the porous glass, and a supersonic wave having a veridical vibration amplitude is used for applying vertical vibration in the container on the oil droplets in the fine pore outlet.

Examples of the supersonic element 3 include a supersonic wave homogenizer (product of Nihon Seiki Seisakusho, Co., Ltd., Model: US-300T, Output: 300 W, Transducer diameter: 26 mm), which generates a vertical vibration amplitude vibrating in vertical direction with respect to the aqueous liquid and is controlled by the number of vibration (vibration frequency) and a voltage. For instance, the homogenizer is capable of generating a vibration having a vibration amplitude of 30 μm in he vertical direction with a vibration frequency of 20 kHz and a current of 400 μA which is controlled by way of the voltage, and a vibration having a vibration amplitude of 10 μm in the vertical direction when a current is 100 μA.

The vibration frequency in the supersonic wave element is preferably from 1 kHz to 1 MHz, more preferably from 3 kHz o 800 kHz. The oil droplets undesirably becomes minute particles to make the diameter too small when the vibration frequency exceeds 1 MHz, while it is difficult to prevent the generation of minute particles and the particle diameter tends to be nonuniform when the vibration frequency is below 1 kHz. The vibration width in vertical direction in the supersonic wave element is preferably from 5 to 100 μm, preferably from 8 to 60 μm, in order to achieve a desired toner particle size. The size of the oil droplets becomes too small when the vertical vibration width exceeds 100 μm, while the size of the oil droplets becomes too large when the vertical vibration width is below 5 μm.

A position for disposing the supersonic wave element 3 or a distance between the supersonic wave element and the porous glass is not particularly limited so far as the position enables the vertical vibration by the supersonic wave to be applied in the direction perpendicular to the direction from which the oily liquid is injected. In the case where the porous glass is disposed in the aqueous liquid along the perpendicular direction, the supersonic wave element is preferably disposed above the porous glass in the aqueous water with a distance of about 10 cm from the porous glass. The position is not necessarily right above the porous glass and is preferably obliquely upward from the porous glass.

In order to vibrate the emulsion oil droplets at the fine pore outlet in the porous glass, the porous glass 1 may directly be vibrated by a supersonic wave vibration if not the above-described method of disposing the supersonic wave element in the aqueous liquid is not employed. In this case, it is necessary to regulate the vibration frequency as small as possible.

Examples of the porous glass 1 include a shirasu porous glass (manufactured by SPG Technology, Co., Ltd.), an etched film, and the like. A section of the porous glass has a multiple of through holes whose section has a cylindrical shape as shown in FIG. 2B, and it is possible to control a fine pore diameter distribution of the porous glass in a narrow range. The fine pore diameter of the porous glass is preferably varied as 2 μm, 3 μm, and the like and is preferably selected appropriately in view of a viscosity of the oily liquid, conditions for the injection, a desired toner diameter, a composition of the aqueous liquid, and the like. It is preferable to keep a value of a dispersion particle diameter of the pigment or the like in the oily liquid to that smaller than the fine pore diameter. A thickness of the porous glass is preferably from 0.2 to 5 mm from the viewpoint of mechanical strength for oily liquid injection, and a surface property of the porous glass may preferably be such that an affinity (wet property) to the aqueous liquid is higher than that to the oily liquid.

The viscosity of the oily liquid at 25° C. detected by a rotating viscometer is preferably from 20 to 500 mP·s (cps), more preferably from 30 to 300 mP·s (cps). A critical pressure for passing the oily liquid through the porous glass becomes too high and clogging tends to be caused when the viscosity is too high, while an amount of solvent is increased to reduce productivity when the viscosity is too low.

The oily liquid is injected into the oily liquid injection member having the porous glass on its side with a constant pressure from above the oily liquid injection member as indicated by an arrow in FIG. 2A. The pressure to the oily liquid is preferably from $1\times10^3$ to $5\times10^5$ Pa, more preferably from $5\times10^3$ to $3\times10^5$ Pa, which is preferably appropriately selected in view of the viscosity of the oily liquid, the size of the fine pore diameter, a concentration of the aqueous liquid, and the desired toner particle diameter. It is necessary to perform the injection with a high pressure when the fine pore diameter is too small, while the toner particle diameter becomes nonuniform, though the productivity is improved, when the pressure is too high. The oily liquid is not injected if the pressure is too low.

The stirring blade 4 is used for the purpose of stirring the aqueous liquid in such a manner as to prevent coalescence of the formed oil droplets and is not limited so far as it can stir the aqueous liquid moderately. It is undesirable to stir the aqueous liquid violently because such violent stirring affects on the oil droplets formation.

Figure 3A:
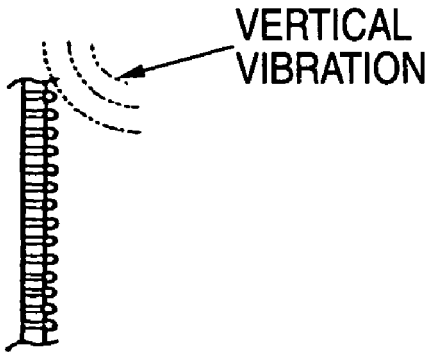
FIGS. 3A to 3C are schematic drawings for illustrating formation of emulsion fine particles in FIGS. 2A and 2B.
Figure 3B:
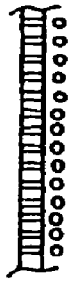
Figure 3C:
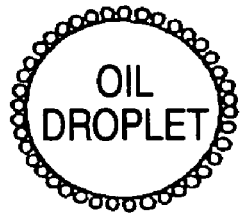

Shown in FIGS. 3A to 3C are schematic drawings illustrating the formation of emulsion fine particles. The oil droplets formed at the fine pore outlet of the porous glass are subject to the vibration in the direction perpendicular to the direction of the injection into aqueous liquid without dragging in FIG. 3A; the oil droplets are released from a surface of the porous glass to immediately take up the dispersion agent and the emulsifier in a water phase as shown in FIG. 3B; and the emulsion fine particles which are stable with the dispersion and the emulsifier attached on surfaces of the oil droplets are formed as shown in FIG. 3C.

The oily liquid is obtainable by dispersing and dissolving a component of a toner made at least from a thermoplastic resin into an organic solvent. Examples of the thermoplastic resin include a synthetic resins used as a toner resin, and it is possible to use the resins described above in paragraphs of the pulverized toner. Particularly, it is preferable to use the styrene-acrylic acid ester based resin, the styrene-methacrylic acid ester based resin, and the polyester resin. A the binder resin, those having a glass transition temperature of from 50° C. to 75° C. and a flow softening temperature of from 100° C. to 150° C. is preferred. It is possible to add the colorant, the release agent, the charge controlling agent, and the like described above in the paragraphs of the pulverized toner to the oily liquid.

Relative proportions are such that, with respect to 100 parts by weight of the thermoplastic resin, the ratio of the colorant is preferably from 0.5 to 15 parts by weight, more preferably from 1 to 10 parts by weight; the ratio of the release agent is preferably from 1 to 10 parts by weight, more preferably from 2.5 to 8 parts by weight; and the ratio of the charge controlling agent is preferably from 0.1 to 7 parts by weight, more preferably from 0.5 to 5 parts by weight.

The oily liquid is prepared by: uniformly kneading the ingredients of the toner particles by the use of a kneader, a loader mill, or a biaxial extruder; roughly pulverizing the mixture; and dissolving and dispersing the roughly pulverized substance into an organic solvent to give the uniformly dispersed oily liquid. Alternatively, after preparing a master batch by the use of the above-described kneader, the proper thermoplastic resin is added to the master batch followed by uniform kneading and a rough pulverization, and then the roughly pulverized substance is dissolved and dispersed into a polar organic solvent. Also, a method wherein the uniform kneading process is omitted and a mixture obtained by mixing the ingredients of the toner mother particles with the organic solvent is dissolved and dispersed to give fine particles by the use of a high speed stirrer or a method wherein the ingredients of the toner mother particles are dispersed to obtain fine particles thereof by the use of a pole mill can be employed.

Examples of the organic solvent are hydrocarbons such as toluene, xylene, and hexane; halogenated hydrocarbon such as methylene chloride, chloroform, dichloroethane, trichloroethane, and carbon tetrachloride; alcohols such as ethanol, butanol, and isopropylalcohol; ketones such as acetone, methylethylketone, and methylisobutylketone; ethers such as benzylalcoholethylether, benzylalcoholisopropylether, tetrahydrofurane; and esters such as methyl acetate, ethyl acetate, and butyl acetate, which can be used alone or in combination of tow or more. The toner ingredients are dissolved and dispersed into the organic solvent to achieve the viscosity of the oily liquid.

As the aqueous liquid into which the oily liquid is injected, an aqueous solution obtained by dissolving and dispersing the dispersion stabilizer and the emulsifier into water is used. Examples of the dispersion stabilizer are metal oxides such as polyvinylalcohol, polyvinylpyrolidone, hydroxymethylcellulose, carboxylmethylcellulose, sodium polyacrylate, tricalcium phosphate, hydroxyapatite, calcium carbonate, and silica.

Examples of the emulsifier to be used in combination with the dispersion stabilizer are alkylbenzene sodium sulfonate such as sodium oleate and dodecylbenzene sodium sulfonate; α-olefin sodium sulfonate, alkyl sodium sulfonate, alkyldiphenylether sodium disulfonate, and the like.

A usage amount of each of the dispersion stabilizer and the emulsifier is preferably from 0.01 to 10 wt %, more preferably from 0.1 to 5 wt % with respect to an amount (solid content weight) of oil droplets to be injected.

After forming the emulsion fine particles corresponding to the toner particle size by injecting into the aqueous liquid the oily liquid obtained by dissolving and dispersing the toner ingredients into the organic solvent, the emulsion solution is heated to a temperature equal to or above a boiling point of the organic solvent or the emulsion solution is sprayed under an atmosphere of the temperature equal t or above the organic solvent by a spray drying apparatus to eliminate the organic solvent, thereby obtaining the toner mother particles. It is possible to prevent coagulation of the toner mother particles by performing the heating at or below the glass transition temperature of the thermoplastic resin.

Examples of the polymerization toner include a toner obtained by a suspension polymerization method and an emulsion polymerizing method. In the suspension polymerization method, a monomer composition obtained by dissolving or dispersing into a polymerizable monomer a coloring pigment and a release agent, and, when so required, a dye, a polymer starting agent, a crosslinking agent, a charge controlling agent, and other additives is added to a water phase containing a suspension stabilizer (water soluble polymer, hardly water soluble inorganic substance) so as to achieve polymerization and particle formation, thereby forming a polymerized toner particles having a desired particle size.

In the emulsion polymerization, a polymerizable monomer and a release agent as well as a polymerization starting agent, an emulsifier (surfactant), and the like as required are dispersed into water to be polymerized, and then a colorant, a charge controlling agent, and a coagulant (electrolyte), and the like are added to the dispersion to form a polymerized toner particles having a desired particle size.

In the materials used for the manufacture of the polymerized toner, it is possible to use the colorant, the release agent, the charge control gent, a fluidity improver which are usable for the pulverized toner described above.

As the polymerizable monomer, any general vinyl based monomer can be used. Examples of the polymerizable monomer are styrene, o-methylstyrene, m-methylstyrene, p-methylstyrene, α-methylstyrene, p-methoxystyrene, p-ethylstyrene, vinyltoluene, 2,4-dimethylstyrene, p-n-butylstyrene, p-phenylstyrene, p-chlorstyrene, divinylbenzene, methyl acrylate, ethyl acrylate, propyl acrylate, acrylic acid-n-butyl, isobutyl acrylate, n-octyl acrylate, dodecyl acrylate, hydroxymethyl acrylate, 2-ethylhexyl acrylate, phenyl acrylate, stearyl acrylate, 2-chrolethyl acrylate, methyl methacrylate, ethyl methacrylate, propyl methacrylate, n-butyl methacrylate, isobutyl methacrylate, n-octyl methacrylate, dodecyl methacrylate, hydroxymethyl methacrylate, 2-ethylhexyl methacrylate, stearyl methacrylate, phenyl methacrylate, acrylic acid, methacrylic acid, maleic acid, fumaric acid, cinnamic acid, ethyleneglycol, propyleneglycol, maleic anhydride, phthalic anhydride, ethylene, propylene, butylene, isobutylene, vinyl chloride, vinylidene chloride, vinyl bromide, vinyl fluoride, vinyl acetate, vinyl propylenate, acrylonitrile, methacrylnitrile, vinylmethylether, vinylethylether, vinylketone, vinylhexylketone, vinylnaphthalene, and the like. As the fluorine containing monomer, 2,2,2-trifluoroethylacrylate, 2,2,3,3-tetrafuloropropylacrylate, vinylidene fluoride, ethylene trifluoride, ethylene tetrafluoride, trifluoropropylene can be used since they have a fluorine atom which is effective for negative charge control.

Any general emulsifier (surfactant) can be used as the emulsifier. Examples of the emulsifier are sodium dodecylbenzene sulfate, sodium tetradecyl sulfate, sodium pentadecyl sulfate, sodium octyl sulfate, sodium oleate, sodium laurate, potassium stearate, calcium oleate, dodecylammoniumchloride, dodecylammonium bromide, dodecyltrimethylammoniumbromide, dodecylpyridiniumchloride, hexadecyltrimethylammoniumbromide, dodecylpolyoxy ethylene ether, hexadecylpolyoxy ethylene ether, laurylpolyoxy ethylene ether, sorbitan monooleate polyoxy ethylene ether, and the like.

Any beneral polymerization starting agent can be used as the polymerization starting agent. Examples of the polymerization starting agent are potassium persulfate, sodium persulfate, ammonium persulfate, hydrogen peroxide, 4,4'-azobiscyanovaleic acid, t-butylhydroperoxide, benzoyl peroxide, 2,2'-azobis-isobutylonitrile, and the like.

Any general coagulant can be used as the coagulant (electrolyte). Examples thereof are sodium chloride, potassium chloride, lithium chloride, magnesium chloride, calcium chloride, sodium sulfate, potassium sulfate, lithium sulfate, magnesium sulfate, calcium sulfate, zinc sulfate, aluminum sulfate, iron sulfate, and the like.

As a method for adjusting a sphericity of the polymerized toner, it is possible to change the sphericity freely by controlling a temperature and a time in a secondary particle coagulation process in the emulsion polymerization, and the sphericity is in the range of 0.94 to 1.00. In the suspension polymerization, since the toner must be spherical, the sphericity is in the range of 0.98 to 1.00. Alternatively, it is possible to adjust the sphericity freely by a heat modification with a temperature higher than a Tg temperature of the toner.

The polymerized toner is obtainable by a dispersion polymerization method, for instance, by a method disclosed in JP 63-304002 A, in addition to the above-described method. In this case, since a shape of the toner becomes nearly spherical, the shape is controlled by pressurizing the toner with a temperature higher than a toner Tg temperature in order to achieve a desired toner shape.

Hereinafter, the external addition treatment will be described. Alumina finer particles are externally added to the toner mother particle. Examples of the alumina fine particles are particles of α-alumina, γ-alumina, and the like; silica alumina composite particles; and the like, and an average particle diameter of a first particles of the alumina fine particles is preferably from 10 to 500 nm (BET specific surface area is from 100 to 1 $m^2/g$), preferably from 13 to 200 nm. A particle diameter of the external additive in this invention has been detected by observing an electron microscopy image.

In general, the alumina fine particles are known as one of the external additive for the toner mother particles. Since surfaces of the alumina fine particles are hydrophilic, in the case where the alumina fine particles are used for the cleanerless image forming apparatus as they are, they undesirably influence on charge characteristic due to a water absorbing property as they deposit on the latent image carrier surface. Though it is necessary to subject the alumina fine particles to a hydrophobication treatment, it is difficult to make the alumina fine particle surface hydrophobic by an ordinary coupling treatment.

The hydrophilic alumina fine particles are low in work function ($\Phi_{A1}$), and the alumina external additive released from the toner firmly adhere to and remain on the latent image carrier, and the transfer voltage is insufficient for transferring the alumina external additive from the latent image carrier surface to the intermediate transfer medium. Therefore, the alumina external additive is accumulated on the latent image carrier surface to undesirably inhibit the formation of electrostatic latent image.

The inventors of this invention have found that: it is possible to insulate the alumina fine particle surface by a hydrophobication treatment by way of a silicon oil treatment to increase the work function ($\Phi_{A1}$); the alumina fine particles undergone the hydrophobication treatment have a week positive charge characteristic, which is a reverse polarity of the polarity of the negatively charge toner, and, by performing the hydrophobication treatment in such a manner as to keep the work function of the alumina fine particles ($\Phi_{A1}$) higher than that of the intermediate transfer medium, it is possible to easily move or transfer the alumina fine particles in a state where the transfer voltage is applied thereon and to reduce the accumulation of the alumina fine particles on the latent image carrier surface; and it is possible to expect an effect of the alumina fine particles of polishing the latent image carrier surface.

Examples of the silicon oil to be used for the hydrophobication treatment of the alumina fine particles are ordinary straight silicon oils such as a dimethyl silicon oil, a methylphenyl silicon oil, a methylhydrogen silicon oil; modified silicon oils such a methacrylic acid modified silicon oil, an epoxy modified silicon oil, a fluorine modified silicon oil, a polyether modified silicon oil, an amino modified silicon oil; and the like. One of or a mixture of the above silicon oils is appropriately selected in view of relationship with the work function ($\Phi_{A1}$).

In the invention, it is preferable that the hydrophobic alumina particle is subjected to a silicon oil treatment. Examples of the silicon oil treatment are a method wherein the alumina fine particles are dispersed into a solution of the silicon oil, and the dispersion is stirred at 20° C. to 50° C. for 20 to 80 minutes, followed by collecting the alumina fine particles by filtering, drying, and pulverizing; a method wherein a solution of the silicon oil is sprayed onto the alumina fine particles, followed by drying and pulverizing; and the like. In the invention, a silicon oil treatment amount of the alumina fine particles is defined as a weight percent (wt %) of a weight of a silicon oil with respect to a weight of alumina fine particles. The silicon oil treatment amount in the invention is preferably from 0.1 to 10 wt %, more preferably from 1 to 8 wt %. A degree of hydrophobication is lowered when the treatment amount is too small, while the alumina fine particles tend to coagulate to influence on the function as the external additive when the treatment amount is too large. The hydrophobication degree is preferably from 40% to 80%, more preferably from 50% to 70%.

An amount of the alumina fine particles undergone the hydrophobication treatment to be added is preferably from 0.01 to 0.3 part by weight, more preferably from 0.05 to 0.2 parts by weight with respect to 100 parts by weight of the toner mother particle. The polishing effect is not expected when the added amount is less than 0.01 part by weight, while the latent image carrier surface and edges of the regulation blade are scratched when the added amount exceeds 0.3 part by weight.

An external additive such as a hydrophobic negatively chargeable silica particles or the like can be added as particles of the external additive in addition to the alumina fine particles. Any one of particles made from a halogenated compound of silicon by a dry method and particles obtained by a wet method of precipitation from a silicon compound in a liquid can be used as the hydrophobic silica particles. It is preferable to mix silica particles varying in average particle diameter distribution when using the hydrophobic negatively chargeable silica particles, and (1) silica particles having an average primary particle diameter of from 5 to 20 nm, preferably from 7 to 16 nm (BET specific surface area: 213 $m^2/g$, for example);

(2) silica particles having an average primary particle diameter of from 30 to 50 nm, preferably from 30 to 40 nm (BET specific surface area: 48 $m^2/g$, for example); and (3) monodisperse spherical silica particles having an average primary particle diameter of from 50 to 500 nm, preferably from 80 to 350 nm (BET specific surface area: 11 $m^2/g$, for example) is preferably used in a weight ratio of (1):(2):(3) =0.4 to 1.4:0.3 to 1.0:0.2 to 0.7. It is possible to achieve a preferable fluidity and a preferable negative charge characteristic by the use of the small diameter silica particles, and it is possible to prevent burying of the external additive particles into the toner mother particles by the use of the large diameter silica particles. A total amount of the hydrophobic negatively chargeable silica particles to be added is preferably from 0.05 to 2 parts by weight with respect to 100 pats by weight of the toner mother particle. The fluidity imparting effect is not achieved when the added amount is less than 0.05 part by weight, while a fixation property is undesirably deteriorated when the added amount exceeds 2 parts by weight. Further, the fixation property is deteriorated when the amount of the small diameter particles is too large, while the fluidity is degraded when the amount is too small. The hydrophobic negatively chargeable silica particles have a negative charge characteristic when the particles behave has released external additive particles to easily transfer onto the intermediate transfer medium surface from the latent image carrier surface.

Additionally, hydrophobic titanium oxide particles is preferably added. A crystalline form of the hydrophobic titanium oxide particles is preferably any of a rutile type, an anatase type, and rutile/anatase mixed crystal type. The rutile/anatase mixed crystal type titanium oxide particles may preferably be used, and examples thereof are a water containing titanium oxide disclosed in JP 2000-128534 A and/or rutile type titanium oxide particles containing anatase type titanium each of which has a spindle-like or a plate-like particle shape wherein a longitudinal axis diameter is from 0.02 to 0.10 μm and an axial ratio (longitudinal axis diameter/minor axis diameter) is from 2 to 8. The rutile/anatase mixed crystal type titanium oxide particles are hardly buried into the toner mother particles thanks to its shape when externally added to the toner mother particles. An amount of the hydrophobic titanium oxide particles to be added is preferably from 0.05 to 2 parts by weight, more preferably from 0.1 to 1.5 parts by weight with respect to 100 parts by weight of the toner mother particles. The charge stability imparting effect is not achieved when the added amount is less than 0.05 part by weight, while the negative charge amount of the toner is undesirably reduced too much when the added amount exceeds 2 parts by weight. The added amount of the hydrophobic titanium oxide particles is preferably from 10 to 150 parts by weight with respect to 100 parts by weight of the hydrophobic silica particles. An overcharge prevention effect is not achieved when the added amount is less than 10 parts by bass, while the negative charge amount of the toner is undesirably reduced too much when the added amount exceeds 150 parts by weight.

The hydrophobic titanium oxide particles has a work function (5.64 eV) higher than that of the hydrophobic alumina fine particles and is easily moved or transferred to the intermediate transfer medium even when they are released.

Other examples are surface modified silica particles obtained by modifying a surface of silica by an oxide or a hydroxide of at least one metal selected from tin, zirconium, and aluminum, which is used in an amount of 1.5 times the silica particles or less by a weight ratio; a titanium oxide metal salt of positively chargeable silica, zinc oxide, magnesium fluoride, silicon carbide, boron carbide, titanium carbide, zirconium carbide, boron nitride, titanium nitride, zirconium nitride, zirconium oxide, calcium carbonate, magnetite, molybdenum disulfide, strontium titanate, and the like; a silicon metal salt; and resin fine particles of an acrylic resin, a styrene resin, a fluorine resin, and the like.

It is preferable to use external additive fine particles other than the alumina fine particles after subjecting then to a hydrophobication treatment using a silane coupling agent, titanium coupling agent, higher aliphatic acid, a silicone oil.

A total amount of the externally added particles to be added in this invention is preferably from 0.1 to 5 wt %, more preferably from 0.5 to 4.0 wt % with respect to the toner mother particles. The fluidity impartation and the charge adjustment are insufficient when the total added amount is less than 0.1 wt %, while not only the deterioration of fixation but also charge imbalance can be caused when the amount exceeds 5 wt %.

A number average molecular weight (Mn) of the toner of this invention when the toner is made into a toner mother particles or toner particles after undergoing external addition treatment is preferably from 1,500 to 20,000, more preferably from 2,000 to 15,000, still more preferably from 3,000 to 12,000, the number average molecular weight being detected by a gel permeation chromatography (GPC) based on polystyrene in a THF soluble part. A coloring agent retention property, filming resistance, offset resistance, fixed image strength, storage stability is deteriorated in spite of excellent low temperature fixation capability when the number average molecular weight is less than 1,500, while the low temperature fixation property is deteriorated when the number average molecular weight exceeds 20,000. Also, a weight average molecular weight (Mw) may preferably from 3,000 to 300,000, more preferably from 5,000 to 50,000, and a Mw/Mn is preferably from 1.5 to 20, more preferably from 1.8 to 8.

The flow softening temperature (Tf½) is preferably in the range of 100° C. to 120° C. A high temperature offset is deteriorated when the flow softening temperature is lower than 100° C., while fixation strength at low temperature is weak when the flow softening temperature is higher than 120° C. The glass transition temperature is in the range of 55° C. to 70° C. Storage stability is degraded when the glass transition temperature is lower than 55° C., while the Tf½ is raised to result in degraded low temperature fixation property when the glass transition temperature is higher than 70° C. The toner in this invention preferably has a melting viscosity at a 50% flowpoint of from $2\times10^3$ to $1.5\times10^4$ Pa·s, which is suitably used as an oilless fixation toner.

An number average particle diameter of the toner mother particles and the toner is preferably 9 μm or less, more preferably from 8 μm to 4.5 μm. Reproducibility of a resolution of a latent image formed with a high resolution of 1,200 dpi or more is low when the number average particle diameter is larger than 9 μm as compared with that achieved by using smaller diameter particles, while a masking property to be achieved by the toner is degraded and the usage amount of the external additive is increased so as to increase the fluidity to result in a degradation of fixation property when the number average particle diameter is smaller than 4.5 μm.

A shape of the toner mother particles and the toner may preferably be spherical. More specifically, an average sphericity R of the toner mother particles, which is represented by the following equation (I):

$$R=L_0/L_1 \qquad (I)$$

{wherein, $L_1$ (am) represents a circumference of a projected image of a toner particle to be measured; and $L_0$ (μm) represents a circumference of a perfect circle having an area equivalent to that of the projected image of the toner particle to be measured} is preferably from 0.96 to 0.99, more preferably from 0.965 to 0.985. Thus, the toner which is high in transfer efficiency, reduced in fluctuation in transfer efficiency in continuous printing, and stable in charge amount is realize.

The average particle diameter and the sphericity of the toner mother particles and the toner particles have been measured by using a flow particle image analyzer (FPIA2100, product of Sysmex Corporation).

The image forming apparatus of this invention preferably has a sphericity R of the toner of 0.96 to 0.99 to realizes the cleanerless system by keeping the high average sphericity, and has a relationship among a work function ($\Phi_t$), a work function ($\Phi_{OPC}$) of the latent image carrier surface in the image forming apparatus, and a work function ($\Phi_{TM}$) of the intermediate transfer material of $\Phi_t > \Phi_{OPC} > \Phi_{TM}$ to achieve a superior transfer efficiency, thereby reducing an amount of toner remaining on the latent image carrier surface after the transfer. Also, by setting a work function ($\Phi_{A1}$) of the hydrophobic alumina fine particles to be larger than the work function ($\Phi_{TM}$) of the intermediate transfer material, it is possible to prevent accumulation of released alumina fine particles and to reduce deposits on the latent image carrier surface thanks to the polishing effect of the hydrophobic alumina fine particles.

A work function ($\Phi$) is known as an energy required for taking out electrons from a substance. The smaller the work function is it is easy to withdraw electrons, while the larger the work function is it is difficult to withdraw the electrons. Accordingly, when a substance having a small work function is allowed to contact with a substance having a large work function, the small work function substance is positively charged, while the large work function substance is negatively charged. The work function is detected y the following measurement method, and numerically rated as an energy (eV) for taking electrons from a substance, thereby enabling a charge characteristic achieved by a contact of a toner containing various substances with each of various members in an image forming apparatus.

The work function is measured by using a surface analyzer (AC-1; product of Riken Keiki Co., Ltd.; low energy electron counting system). In this invention, the measurement using the above analyzer was conducted by: irradiating a sample with light with the use of a deuterium lamp; setting an irradiated light amount to 10 nW for the development roller plated with metal; setting an irradiated light amount for each of other members to 500 nW; selecting monochromatic light by the use of a spectroscope; setting a spot size to 4 mm; setting an energy scanning range to 3.4 to 6.2 eV; and setting a measurement time to 10 sec/1 point. The photoelectrons discharged from a surface of the sample was detected, which is then subjected to an arithmetic operation by the use of a work function measurement soft, and the work function is measured with a repetition accuracy (standard deviation) of 0.02 eV. As a measurement environment for ensuring data reproducibility, the measurement samples were used at a temperature and relative humidity of 25° C. and left under the condition of 55% RH for 24 hours.

Figure 4A:
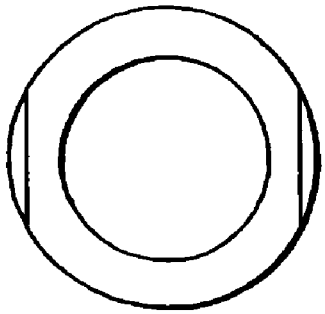
Figure 4B:
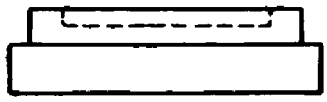

As shown in FIGS. 4A and 4B, a toner-dedicated measurement cell is a stainless disk having a diameter of 13 mm and a height of 5 mm with a toner containing depression having a diameter of 10 mm and a depth of 1 mm at the center thereof. A sample toner is placed on the depression of the cell using a weighing spoon without tamping down, and then a surface thereof is flattened using a knife edge to be subjected to the measurement. After fixing the measurement cell filled with the toner at a prescript position, the measurement is conducted under the conditions of the irradiated light amount of 500 nW, the spot size of 4 mm square, and the energy scanning range of 4.2 to 6.2 eV.

Figure 5A:
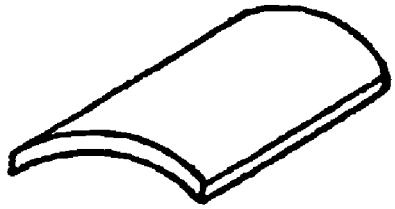
Figure 5B:
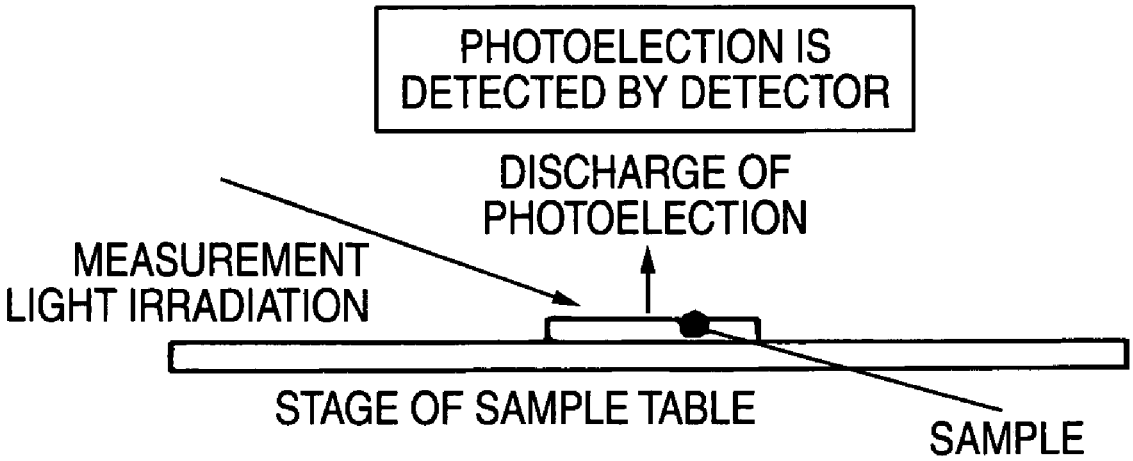

In the case where the sample has a cylindrical shape, such as the photoreceptor and the development roller of the image forming apparatus, the member is cut into pieces so that each of the pieces has a width of 1 to 1.5 cm, and then each piece is cut along a ridge and in a horizontal direction to obtain a measure sample piece having the shape shown FIG. 5A. The measurement sample piece is fixed on a prescribed position on a sample table in such a fashion that an irradiated surface is flat with respect to a direction of measurement light irradiation as shown in FIG. 5B. Thus, discharge photoelectrons are efficiently detected by a detector (photoelectron image intensifying tube). In the case where the intermediate transfer belt, the regulation blade, and the photoreceptor are sheet-like, a sample piece must have a size of at least 1 cm square because the measurement light is to be emitted with a spot of 4 mm square as described above to be fixed on the sample table as shown in FIG. 5B for the measurement.

Figure 6:
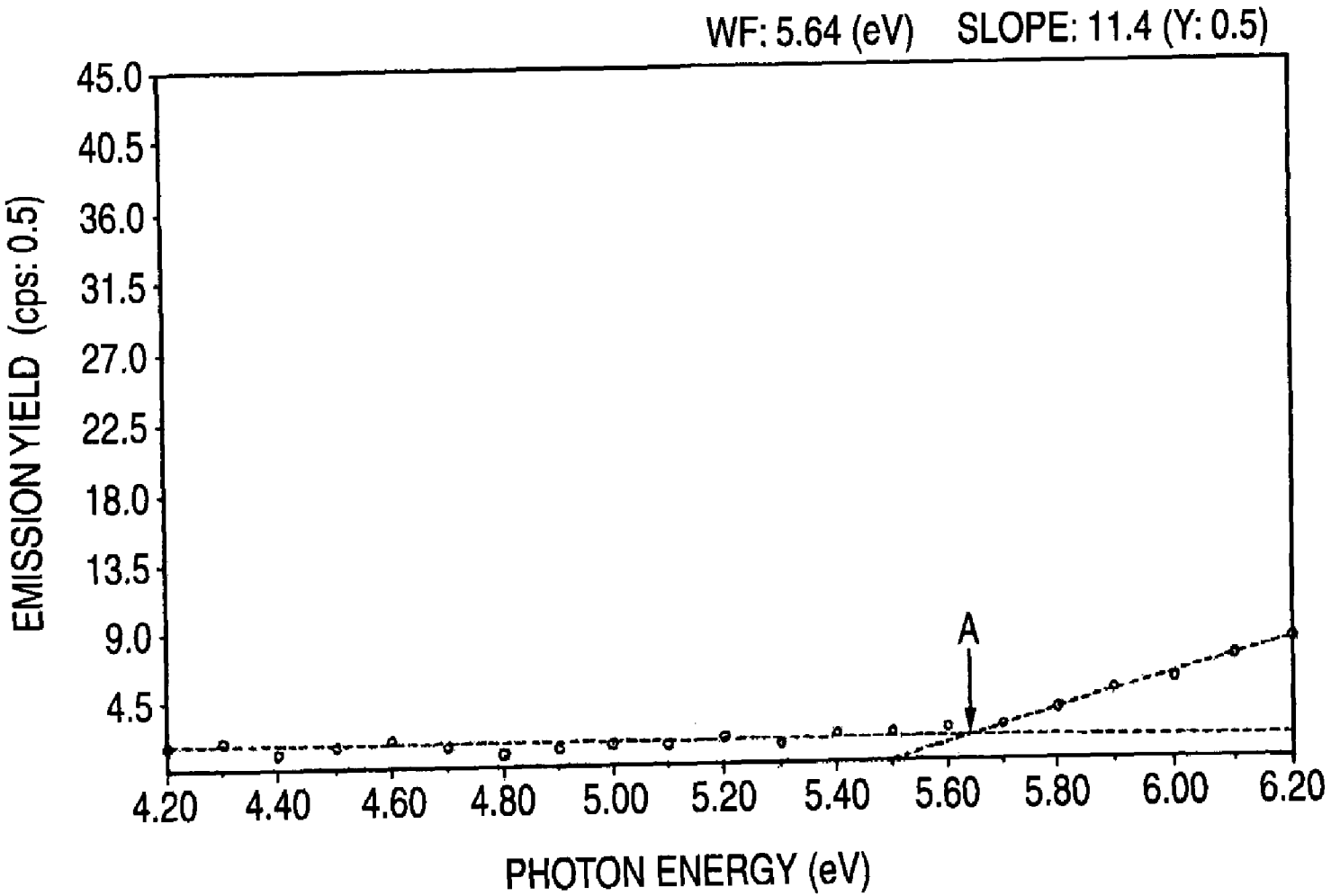
FIG. 6 is a drawing showing one example of a chart obtained by measuring the toner work function by using a surface analyzer.

IN this surface analysis, photon discharge starts at a certain energy value (eV) by scanning the excitation energy of monochromatic light in the order of increasing the excitation energy, and the energy value is detected as the work function. One example of a chart obtained on the toner is shown in FIG. 6. In FIG. 6, a horizontal axis is the excitation energy (eV), and a vertical axis is a standardized photon yield (a photoelectron yield per unit photon raised to n-th power), so that a constant slope (Y/eV) is obtained. In the case of FIG. 6, the work function is represented by an excitation energy value (eV) at a flexion point (A).

The work function of the toner ($\Phi_t$) is preferably from 5.4 to 5.9 eV, more preferably from 5.45 to 5.8 eV. A range of usable latent image carriers and intermediate transfer materials is narrowed when the toner work function is low, while a content of the coloring pigment in the toner is lowered when the work function is too high.

The work function ($\Phi_{OPC}$) of the latent image carrier (photoreceptor) is preferably from 5.2 to 5.6 eV, more preferably from 5.25 to 5.5 eV. It is difficult to select a usable charge transport agent when the work function is less than 5.2 eV, while it is difficult to select a usable charge generation agent when the work function exceeds 5.6 eV.

The work function ($\Phi_{TM}$) of the intermediate transfer medium surface is preferably from 4.9 to 5.5 eV, more preferably from 4.95 to 5.45 eV. Material designing for the toner is difficult when the intermediate transfer medium surface work function ($\Phi_{TM}$) is larger than 5.5 eV, while a content of the electroconductive agent in the intermediate transfer medium is increased too much to result in mechanical strength of the intermediate transfer medium is reduced too much when the work function is smaller than 4.9 eV.

It is preferable to set a difference of at least 0.2 eV, preferably at least 0.25 eV, among the work functions. Specifically, it is preferable that the difference between the work function of the negatively chargeable spherical toner and that of the surface of the latent image carrier is at least 0.2 eV, and the difference between the work function of the surface of the latent image carrier and that of the surface of the intermediate transfer medium is at least 0.2 eV.

In the image forming apparatus of this invention, since it is possible to make the small particle positively chargeable toner particles which are not charged by contact with the toner regulation member into negatively chargeable toner by the contact with the photoreceptor, the toner does not adhere to a non-image region which is negatively charged, thereby reducing fogging. Also, it is possible to improve the transfer efficiency and to obtain a high quality image even when the transfer voltage is unchanged. Also, when the work function of the regulation blade is kept smaller than the toner work function, it is possible to prevent generation of reversely charged toner.

The work function ($\Phi_{A1}$) of the alumina fine particles is preferably from 5.1 to 5.7 eV, more preferably from 5.15 to 5.65 eV. A difference between the work function ($\Phi_{A1}$) of the alumina fine particles and the intermediate transfer medium surface work function ($\Phi_{TM}$) is preferably at least 0.2 eV, more preferably 0.25 eV or more.

A full color image forming apparatus is achieved by combing a developer using toners of yellow Y, cyan C, magenta M, and black K and the photoreceptor in the development process in the image forming apparatus shown in FIG. 1. One example of full color printer of a rotary system is shown in FIG. 7, and one example of tandem system full color printer is shown in FIG. 8.

Figure 7:
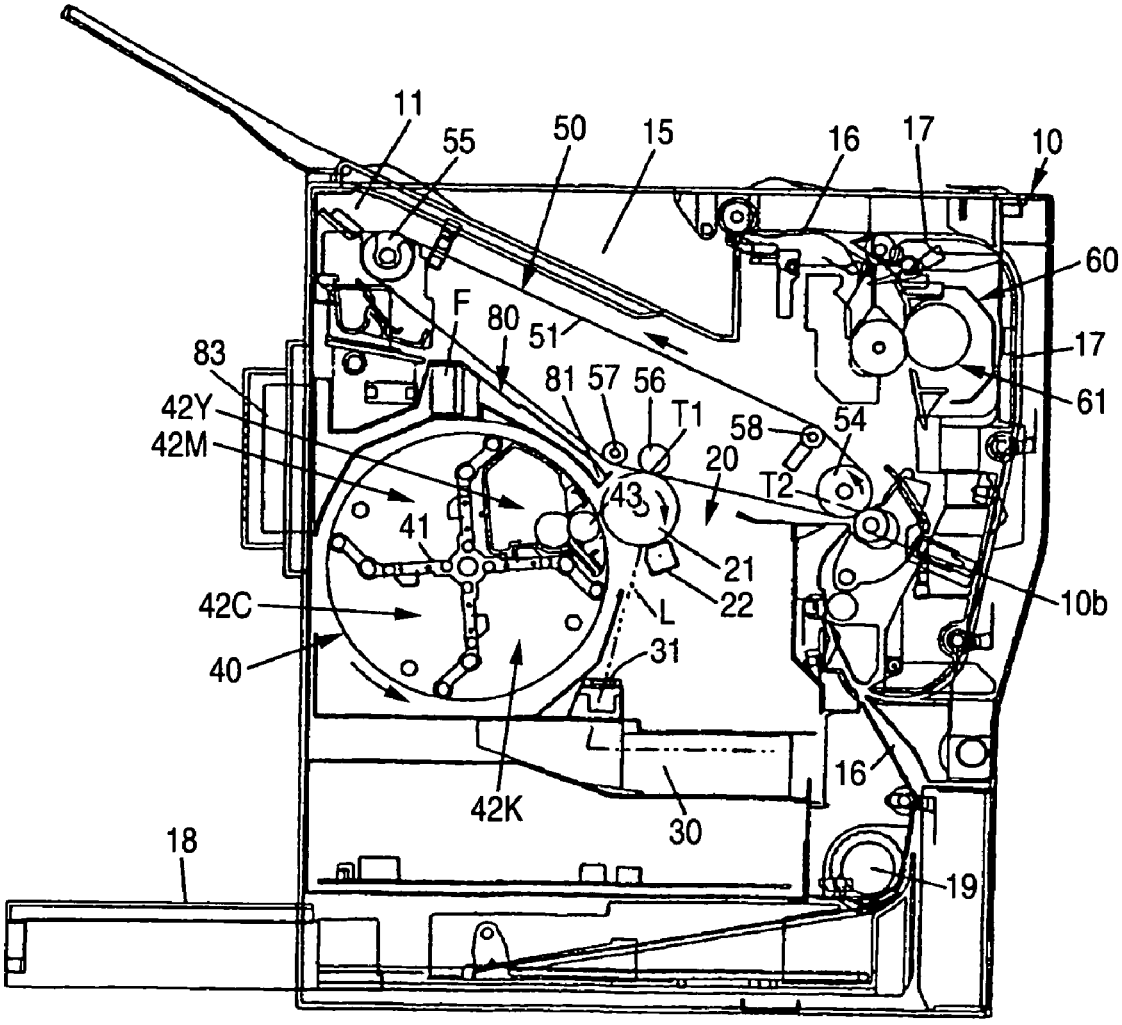
FIG. 7 is a drawing for illustrating one example of a cull color printer in the image forming apparatus of this invention.
Figure 8:
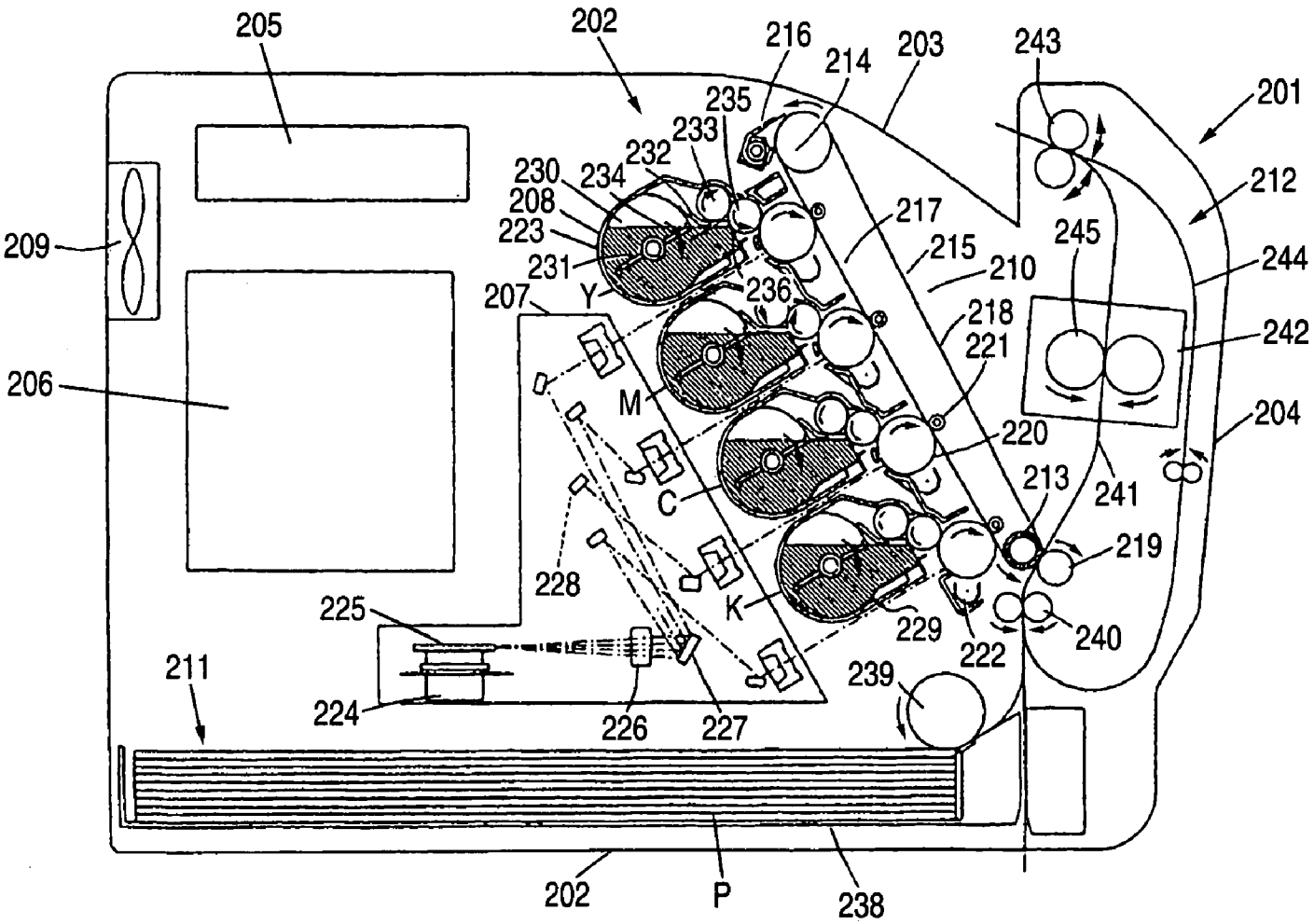
FIG. 8 is a drawing for illustrating one example of a tandem system in the image forming apparatus of this invention.

FIG. 7 is an illustration for the color image forming apparatus of a batch transfer 4 cycle rotary development system according to this invention.

This image forming apparatus is a color image forming apparatus capable of forming a full color image on both sides of a recording materials such as a sheet of paper and provided with a case 10, an image carrier member 20 housed in the case 10, an exposure member 30, a developer (developing device) 40, an intermediate transfer member 50, and a fixation member (fixer) 60.

A frame (not shown) of the apparatus is provided in the case 10, and the above members are mounted on the frame.

The image carrier member 20 has a latent image carrier (photoreceptor) 21 having a photosensitive layer formed on its outer peripheral surface, and a charging member (scorotoron charger) 22 for uniformly charging the outer peripheral surface of the photoreceptor 21. The outer peripheral surface of the photoreceptor 21 charged uniformly by the charging member 22 is selectively irradiated with laser light L from the exposure member 30 to give an electrostatic latent image, and the electrostatic latent image is made into a visible image (toner image) by applying the toner which is the developing agent by the use of the developer 40. The toner image is primarily transferred onto an intermediate transfer belt 51 of the intermediate transfer member 50 by the use of a primary transfer member T1 and then secondarily transferred onto a paper by the use of a secondary transfer member T2.

A conveying path 16 for conveying the paper on whose one side an image is formed by the secondary transfer member T2 to a sheet discharge member (discharged sheet tray) 15 provided on an upper surface of the case 10 and a return path 17 for returning to the secondary transfer member T2 the paper conveyed to the paper discharge member 15 via the conveying path 16 by switch-backing so as to form an image on the other side are provided in the case 10.

A sheet feeding tray 18 in which a plurality of paper sheets are retained in an accumulated fashion and a feeding roller for feeding the paper sheets one by one to the secondary transfer member T2 are provided in a lower part of the case 10.

The developer 40 is a rotary developer on which a plurality of developer cartridges each housing a toner are detachably mounted. In this embodiment, a yellow developer cartridge 42Y for, a magenta developer cartridge 42M, a cyan developer cartridge 42C, and a black developer cartridge 42K are provided (only the yellow developer cartridge 42Y is shown in the drawing), an a rotor 41 rotates in a direction of an arrow at a 90-degree pitch to allow the developer roller 43 to face the photoreceptor 21, thereby selectively developing the surface of the photoreceptor 21.

The exposure member 30 emits the laser light L toward the photoreceptor 21 through an exposure window 31 formed from a plate glass.

The intermediate transfer member 50 has a unit frame (not shown), a driving roller 54 rotatably supported by the frame, a driven roller 55, a primary transfer roller 56, a guide roofer 57 for stabilizing a state of a belt 51 in the primary transfer member T1, a tension roller 58, and the intermediate transfer belt 51 hung on the rollers to be tightened, and the belt 51 is driven to circulate in a direction indicated by an arrow in the drawing.

The primary transfer member T1 is formed between the photoreceptor 21 and the primary transfer roller 56, and the secondary transfer member T2 is formed at a position where the driving roller 54 contacts with the secondary transfer roller 10*b* provided near the body.

The secondary transfer roller 10*b* contacts with and departs from the driving roller 54 (i.e. the intermediate transfer belt 51), and the secondary transfer member T2 is formed at the contact.

Accordingly, in the case of forming a color image, toner images of plural colors are superimposed on the intermediate transfer belt 51 in a state where the secondary transfer roller 10*b* is separated from the intermediate transfer belt 51, and then the secondary transfer roller 10*b* contacts the intermediate transfer belt 51 followed by supply of a sheet to the contact portion (secondary transfer member T2), thereby transferring the color image (toner image) on the sheet.

The sheet on which the toner image has been transferred passes through a pair of heating rollers 61 of the fixation member 60 so that the toner image is melt fixed and then discharged toward the discharge tray member 15. The fixer 60 is an oilless fixer which does not require application of oil on the heating rollers 61.

FIG. 87 is an illustration of one example of the tandem color printer.

An image forming apparatus 201 does not have any cleaning member in a latent image carrier and is provided with a housing 202, a discharged paper tray 203 formed in an upper part of the housing 202, a cover 204 capable of opening/closing and mounted on a front surface of the housing 202. Inside the housing 202, a control member 205, a power unit 206, an exposure member 207, an image forming member 208, a exhaust fan, 209, a transfer member 210, a sheet feeding member 211 are provided, and a sheet conveying member 212 is provided in the cover 204. Each of the members is detachable from the image forming apparatus body and can be detached integrally for a maintenance to be repaired or replaced.

The transfer member 210 is provided with a driving roller 213 rotatably driven by a driving source (not shown) provided below the housing 202, a driven roller provided at a position obliquely upward from the driving roller 213, and an intermediate transfer belt 215 tighten by the two rollers and driven to circulate in a direction indicated by an arrow in the drawing (anticlockwise direction), and the driven roller 214 and the intermediate transfer belt 215 are provided in such a fashion as to inclined leftward from the driving roller 213. Thus, a belt stretching side (part pulled by the driving roller 213) 21 of the intermediate transfer belt 215 located below while a belt sagging side 218 is located above at the time of driving.

The driving roller 213 serves also as a backup roller for a secondary transfer roller 219 described later in this specification. On a periphery of the driving roller 213, a rubber layer having a thickness of about 3 mm and a volume resistance of $1\times10^5$ Ω·cm or less is formed to be used as an electroconductive path for a secondary transfer bias supplied via the secondary transfer roller when earthed using a metal axis. By thus providing the rubber layer which is of high friction and impact absorption to the driving roller 213, impact at the time when the recording material enters the secondary transfer member is hardly transmitted to the intermediate transfer belt 215, thereby preventing image quality degradation.

Also, a diameter of the driving roller 213 is made smaller than that of a driven roller 214. Therefore, the recording sheet after the secondary transfer is easily separated by an elastic force of the recording sheet itself.

A primary transfer member 221 is brought into contact with a back side of the intermediate transfer belt 215 in such a fashion as to face latent image carriers 220 of the single color image forming members Y, M, C, and K constituting an image forming member 208 described later in this specification, and a transfer bias is applied to the first transfer member 221.

The image forming member 208 is provided with the single color image forming members Y (yellow), M (magenta), C (cyan), and K (black) which are used for forming images of different colors, and each of the single color image forming members Y, M, C, and K is provided with the latent image carrier 220 having a photoreceptor on which an organic photosensitive layer and an inorganic photosensitive layer are formed, a charging member 222 having a corona charger or a charging roller disposed around the latent image carrier 220, and a developing member 223.

The latent image carriers 220 of the single image forming member Y, M, C, and K are allowed to contact with the belt stretching side 217 of the intermediate transfer belt 215, so that the single color image forming members Y, M, C, and K are disposed in such a fashion as to inclined leftward from the driving roller 213. The latent image carriers 20 are rotatably driven in a direction indicated by an arrow in the drawing, which is reverse to the rotation direction of the intermediate transfer belt 215.

The exposure member 207 is disposed obliquely below the image forming member 208 and provided with a polygon mirror motor 224, a polygon mirror 225, an f-θ lens 226, a reflection mirror 227, and a return mirror 228. Image signals respectively corresponding to different colors are emitted from the polygon mirror as being modified based on a common data clock frequency and then projected onto the latent image carriers 220 of the single image forming members Y, M, C, and K via the f-θ lens 226, the reflection mirror 227, and return mirror 228, whereby a latent image is formed. Light passage length to the latent image carriers 220 of the single color image forming members Y, M, C, and K are substantially the same thanks to the function of the return mirror 228.

Hereinafter, a developing member 223 of the single color image forming member Y will be described as a representative example of the developing members 223. In this embodiment, since the single color image forming members Y, M, C, and K are disposed in such a fashion as to be inclined leftward in the drawing, a toner container 229 is disposed in such a fashion as to be inclined obliquely downward.

More specifically, the developing member 223 is provided with the toner container 229 for containing a toner, a toner storage member 230 formed inside the toner container 229 (hatching in the drawing), a toner stirring member 231 disposed inside the toner storage member 230, a partition member 232 defined in an upper part of the toner storage member 230, a toner supply roller 233 disposed above the partition member 232, a charging blade 234 provided in the partition member 232 to be brought into contact with the toner supply roller 233, a development roller 235 disposed adjacent to the toner supply roller 233 and the latent image carrier 220, and a regulation blade 236 to be brought into contact with the development roller 235.

The development roller 235 and the toner supply roller 233 are rotatably driven in a direction reverse to a rotation direction of the latent image carrier 220, and the stirring member 231 is rotatably driven in a direction reverse to the rotation direction of the supply roller 233. The toner stirred and conveyed by the stirring member 231 in the toner storage member 230 is supplied to the toner supply roller 233 along a front surface of the partition member 232. The toner is then brought into slide scraping with the charging blade 234 made from a flexible material to be supplied onto a surface of the development roller 235 by way of a mechanical force of a surface of the supply roller 233 of adhering to uneven portion and an adhering force due to frictional electrification.

The toner supplied to the development roller 235 is regulated to be a thin layer having a predetermined thickness by the regulation blade 236. The thin layered toner is conveyed to the latent image carrier 220, and an electrostatic latent image of the latent image carrier 220 is developed at a developing region at which the developing roller 235 approaches to the latent image carrier 220 to be adjacent to the latent image carrier 220.

During the image formation, a sheet feeding member 211 is provided with a sheet feeding cassette 238 in which a plurality of recording materials S are retained in an accumulated fashion and a pick up roller 239 for feeding the recording materials one by one from the sheet feeding cassette 238.

The sheet conveying member 212 is provided with a pair of gate rollers 240 defining a timing for feeding the recording material S to the secondary transfer member (one of the rollers is provided a the side of the housing 202), a secondary transfer roller 219 serving as a secondary transfer member to be brought into pressure contact with the driving roller 213 and the intermediate transfer belt 215, a main recording material conveying path 241, a fixation member 242, a pair of sheet discharge roller 243, and a conveying path for double sided printing 244, and the toner remaining on the intermediate transfer belt 215 after the transfer onto the recording material is removed by a cleaning member 216.

The fixation member 242 is provided with a pair of rotatable fixation rollers at least one of the rollers has a heat generator and a pressing member for pressing against the recording material S a secondary image secondarily transferred onto the sheet material by pressing one of the fixation rollers 245 against the other roller, the secondary image secondarily transferred onto the recording material is fixed onto the recording material by a nip portion formed by the fixation rollers 245 at a predetermined temperature.

Since the intermediate transfer belt 215 is disposed in such a fashion as to incline leftward in the drawing from the driving roller 213, a wide space is made on the right hand side wherein the fixation member is disposed. Thus, it is possible to realize downsizing of the image forming apparatus and to prevent adverse influence otherwise exerted by the heat generated in the fixation member 242 onto the exposure member 207, the intermediate transfer belt 215, and the single color image forming members Y, M, C, and K disposed on the left hand side.

EXAMPLES

The present invention is now illustrated in greater detail with reference to Examples and Comparative Examples, but it should be understood that the present invention is not to be construed as being limited thereto.

Production examples of each of members, toners, and hydrophobic alumina fine particles in image forming apparatuses used in the following embodiments will be described.

Production of Organic Photoreceptor 1

A coating liquid obtained by dissolving and dispersing 6 parts by weight of an alcohol soluble nylon (CM8000; product of Toray Industries, Inc.) and 4 parts by weight of aminosilane-treated titanium oxide fine particles into 100 parts by weight of methanol was applied on a periphery of an electroconductive support obtained by surface-polishing a aluminum solid drawn tube having a diameter of 30 mm as an underlayer by the ring coating method, followed by drying at 100° C. for 40 minutes to form an underlayer having a film thickness of from 1.5 to 2 μm.

A pigment dispersion obtained by dispersing 1 part by weight of an oxytitanyl phthalocyanine pigment, a butyral resin (BX-1, product of Sekisui Chemical Co., Ltd.), and 100 parts by weight of dichloroethane using a sand mill using glass beads having a diameter of 1 mm for 8 hours was applied on the thus-obtained underlayer, followed by drying at 80° C. for 20 minutes to obtain a charge generation layer having a film thickness of 0.3 μm.

A mixture obtained by dissolving 40 parts by weight of a charge transport substance of a styryl compound having the following structural formula (1) and 60 parts by weight of a polycarbonate resin (Panlite TS; product of Teijin Chemicals, Ltd.) into 400 parts by weight of toluene was applied on the thus-obtained charge generation layer by a dip coating method followed by drying to form a charge transport layer having a dried film thickness of 22 μm, thereby producing a multilayer organic photoreceptor {OPC(1)}.

(1)

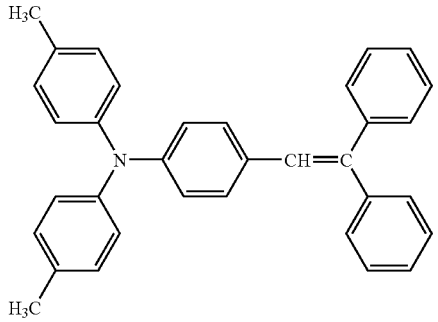

A portion of the thus-obtained organic photoreceptor is cut to use the cut portion as a sample piece, and a work function of the sample piece was measured by using a surface analyzer (AC-2 type, product of Riken Keiki Co., Ltd.) with a irradiated light amount of 500 nW. The detected work function was 5.47 eV.

Production of Organic Photoreceptor 2

An organic photoreceptor {OPC (2)} was produced in the same manner as in the production of the organic photoreceptor 1 except for using a distyryl compound of the following structural formula (2) as the charge transport substance. A work function was measured under the same conditions, and the detected work function was 5.50 eV.

(2)

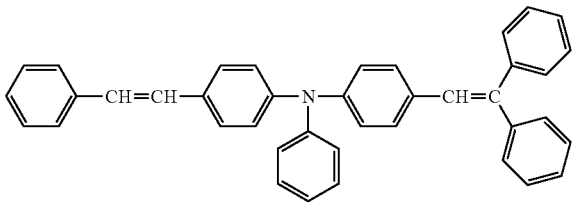

Production Example of Development Roller

A blast treatment and then an electroless nickel plating (thickness: 8 μm) were performed on a surface of an aluminum pipe having a diameter of 18 mm. A surface roughness (Ra) of the thus-obtained development roller was 3 μm. A work function of the development roller was measured under the same conditions, and the detected work function was 4.58 eV.

Production Example of Regulation Blade

An electroconductive urethane rubber chip having a thickness of 1.5 mm was attached on an SUS plate having a thickness of 80 μm using an electroconductive adhesive. A work function of the urethane rubber surface detected under the same conditions was 5.01 eV.

Production Example of Intermediate Transfer Belt 1

85 parts by weight of polybutylenetelephthalate, 15 parts by weight of polycarbonate, and 15 parts by weight of acetylene black were mixed using a mixer under a nitrogen atmosphere, and the thus-obtained mixture was kneaded by using a biaxial extruder under a nitrogen gas atmosphere to palletize the mixture. The pellet was extruded by the use of a monoaxial extruder having a circular dice at 260° C. to obtain a tube-like film having an outer diameter of 170 mm and a thickness of 160 μm. Then an inner diameter of the molten tube was defined by a cooling inside mandrel supported on an axis line same as that of the circular dice to solidify the tube by cooling, thereby obtaining a seamless tube. The seamless tube was cut in accordance with a prescribed dimension to obtain a seamless belt having an outer diameter of 172 mm, a width of 342 mm, and a thickness of 150 μm. A volume resistance of the transfer belt was $3.2\times10^{8}$ Ω·cm.

A work function of the transfer belt was measured under the same conditions, and the detected work function was 5.19 eV and a detected standardized photoelectron yield was 10.88.

Production Example of Intermediate Transfer Belt 2

A Uniform Dispersion Prepared by Using:

30 parts by weight of a polyvinyl chloride-vinyl acetate copolymer;

10 parts by weight of an electroconductive carbon black; and 70 parts by weight of methyl alcohol was applied on a polyethylene telephthalate resin film on which aluminum was deposited by vapor deposition and having a thickness of 130 μm by a roll coating method followed by drying to achieve a film thickness of 20 μm, thereby obtaining an intermediate electroconductive layer.

Then, on the thus-obtained intermediate electroconductive layer, a coating liquid obtained by mixing dispersion of a composition containing:

55 parts by weight of a nonionic water based urethane resin (solid content: 62 wt %);

11.6 parts by weight of a polytetrafluoroethylene emulsion resin (solid content: 60 wt %);

5 parts by weight of electroconductive titanium oxide;

25 parts by weight of electroconductive tin oxide;

34 parts by weight of polytetrafluoroethylene fine particles (max particle system: 0.3 μm or less);

5 parts by weight of polyethylene emulsion (solid content: 35 wt %); and 20 parts by weight of ion exchange water was applied by the roll coating method followed by drying to achieve a film thickness of 10 μm, thereby forming a transfer layer.

The thus-obtained coating sheet was cut into pieces each having a length of 540 mm, and edges of the pieces were matched with the coating surface being a top surface to perform a supersonic welding, thereby producing an intermediate transfer medium (transfer belt). A volume resistance of the transfer belt was $8.8\times10^{9}$ Ω·cm. A work function and a standardized photoelectron yield of the intermediate transfer medium were 5.69 and 7.39, respectively.

Production Example of Hydrophobic Alumina 1 by Gas Phase Method

Dimethyl silicon oil in an amount of 0.6 g was mixed with a mixture solution of 150 ml of toluene and 60 ml of ethyl acetate, and then the mixture was subjected to a supersonic dispersion (US-300T Type; product of Nihon Seiki Seisakusho, Co., Ltd.) for 1 minute to be uniformly dispersed. In the thus-obtained dispersion, 9 g of hydrophilic alumina 1 shown in Table 1, which had been obtained by a gas phase method, was thrown followed by the supersonic dispersion for 3 minutes. After that, the dispersion was filtrated by a reduced pressure filtration, and the filtrate was dried at 65° C. for 5 hours, followed by pulverization suing a blender (Commercial Laboratory Blender; product of Waring Products, Inc.) to obtain hydrophobic alumina 1 having a BET specific surface area of 75 $m^2/g$ by the gas phase method.

A work function of the thus-produced hydrophobic alumina 1 by gas phase method was measured by using the surface analyzer (AC-2 Type; product of Riken Keiki Co., Ltd.) with an irradiated light amount of 500 nW, and the detected work function was 5.36 eV.

Production Example of Hydrophobic Alumina 2 by Gas Phase Method

Hydrophobic alumina 2 by gas phase method having a BET specific surface area of 70 $m^2/g$ was obtained in the same manner as in the production example of the hydrophobic alumina 1 by gas phase method except for using methylphenyl silicon in place of dimethyl silicon oil. A work function of the thus-obtained hydrophobic alumina 2 was measured in the same manner, and the detected work function was 5.38 eV.

Production Example of Hydrophobic Alumina 3 by Gas Phase Method

Hydrophobic alumina 3 by gas phase method having a BET specific surface area of 43 $m^2/g$ was obtained in the same manner as in the production example of the hydrophobic alumina 1 by gas phase method except for using methylhydrogen silicon in place of dimethyl silicon oil. A work function of the thus-obtained hydrophobic alumina 3 was measured in the same manner, and the detected work function was 5.40 eV.

BET specific surface areas, particle diameters, and work functions of external additives used for the production of toners described later in this specification are shown in Table 1.

TABLE 1

| External additive | BET specific surface area ($m^2/g$) | Particle diameter (nm) | Work function (eV) |
|---|---|---|---|
| Hydrophobic rutile anatase type titanium oxide | 124 | 12 | 5.64 |

TABLE 1-continued

| External additive | BET specific surface area ($m^2/g$) | Particle diameter (nm) | Work function (eV) |
|---|---|---|---|
| Hydrophobic negatively chargeable silica by gas phase method | 213 | 12 | 5.22 |
| Hydrophobic negatively chargeable silica by gas phase method | 48 | 40 | 5.24 |
| Hydrophobic negatively chargeable monodisperse spherical silica | 11 | 100 | 5.27 |
| Hydrophilic alumina 1 by gas phase method | 93 | 13 | 5.29 |
| Hydrophobic alumina 1 by gas phase method | 75 | 14 | 5.38 |
| Hydrophobic alumina 2 by gas phase method | 70 | 14 | 5.36 |
| Hydrophilic alumina 2 by gas phase method | 50 | 30 | 5.27 |
| Hydrophobic alumina 3 by gas phase method | 43 | 31 | 5.04 |

Production of Toner 1

A monomer mixture containing 80 parts by weight of a styrene monomer, 20 parts by weight of butyl acrylate, and 5 parts by weight of acrylic acid was added to a water soluble mixture containing:

105 by weight of water;

1 part by weight of a nonionic emulsifier;

1.5 parts by weight of an anionic emulsifier; and 0.55 part by weight of potassium persulfate, followed by stirring under nitrogen gas stream at 70° C. for 8 hours.

The mixture was cooled after a polymerization reaction to obtain an opalescent resin emulsion having a particle diameter of 0.25 μm.

Then, 200 parts by weight of the thus-obtained resin emulsion, 20 parts by weight of a polyethylene wax emulsion (product of Sanyo Kasei Co., Ltd.), 7 parts by weight of phthalocyanine blue were dispersed into a water containing 0.2 part by weight of dodecylbenzene sodium sulfonate which is a surfactant. Diethylamine was added to this dispersion liquid to adjust a pH value to 5.5, and then 0.3 part by weight of aluminum sulfate which is an electrolyte was added with stirring, followed by dispersion by way of high speed stirring using a TK homomixer.

To the dispersion liquid, 40 parts by weight of a styrene monomer, 10 parts by weight of butyl acrylate, 5 parts by weight of zinc salicylate, and 40 parts by weight of water were added. This mixture was stirred under the nitrogen gas stream with heating to 90° C. in the same manner, followed by adding to the mixture hydrogen peroxide to allow polymerization for 5 hours, thereby growing particles.

After stopping the polymerization, the mixture was heated to 95° C. with a pH value being adjusted in order to increase bond strength of associated particles, followed by retention of 5 hours. The thus-obtained particles were washed with water followed by vacuum drying at 45° C. for 10 hours.

The thus-obtained cyan toner mother particles were subjected to measurements using a flow particle image analyzer (FPIA2100; product of Sysmex) to detect that the particles had a number average particle diameter of 6.8 μm and a sphericity of 0.980. A work function of the particles was measured using the surface analyzer (AC-2 Type; product of Riken Keiki Co., Ltd.) with an irradiated light amount of 500 nW, and the detected work function was 5.57 eV.

To this toner mother particles, 0.5 wt % of the hydrophobic negatively chargeable silica by gas phase method (BET specific surface area: 213 $m^2/g$), 0.3 wt % of the hydrophobic negatively chargeable silica by gas phase method (BET specific surface area: 48 $m^2/g$), and 0.2 wt % of the hydrophobic negatively chargeable monodisperse spherical silica (BET specific surface area: 11 $m^2/g$) were added and mixed, followed by adding to the mixture 0.5 wt % of the hydrophobic rutile anatase type titanium oxide (BET specific surface area: 124 $m^2/g$) and 0.2 wt % of the hydrophobic alumina 1 by gas phase method to obtain a toner 1-(1). A work function of the toner 1-(1) detected in the same manner was 5.56 eV.

A toner 1-(2) was obtained in the same manner except for using the hydrophobic alumina 2 by gas phase method in place of the hydrophobic alumina 1 by gas phase method. A work function of the toner 1-(2) detected in the same manner was 5.56 eV.

For comparison, a toner 1-(3) was obtained in the same manner except for using the hydrophilic alumina 1 by gas phase method in place of the hydrophobic alumina 1 by gas phase method. A work function of the toner 1-(3) detected in the same manner was 5.55 eV.

Production of Toner 2

A magenta toner 2-(1) was produced in the same manner as in the production process of toner 1 except for changing the pigment from phthalocyanine blue to quinacridone and keeping the temperature for increasing association of second particles and film bond strength to 90° C. The thus-obtained magenta toner 2-(1) had a number average particle diameter of 6.9 μm and a sphericity of 0.972. A work function of the toner 2-(1) was detected to be 5.63 eV.

A toner 2-(2) was obtained in the same manner except for using the hydrophobic alumina 2 by gas phase method in place of the hydrophobic alumina 1 by gas phase method. A work function of the toner 2-(2) detected in the same manner was 5.63 eV.

For comparison, a toner 2-(3) was obtained in the same manner except for using the hydrophilic alumina 1 by gas phase method in place of the hydrophobic alumina 1 by gas phase method. A work function of the toner 2-(3) detected in the same manner was 5.62 eV.

Production of Toner 3

A yellow toner 3-(1) was produced in the same manner as in the production process of toner 2 except for changing the pigment to pigment yellow 180. The thus-obtained yellow toner 3-(1) had a number average particle diameter of 6.9 μm and a sphericity of 0.972. A work function of the toner 2-(1) was detected to be 5.60 eV.

A toner 3-(2) was obtained in the same manner except for using the hydrophobic alumina 2 by gas phase method in place of the hydrophobic alumina 1 by gas phase method. A work function of the toner 3-(2) detected in the same manner was 5.60 eV.

For comparison, a toner 3-(3) was obtained in the same manner except for using the hydrophilic alumina 1 by gas phase method in place of the hydrophobic alumina 1 by gas phase method. A work function of the toner 3-(3) detected in the same manner was 5.59 eV.

Production of Toner 4

A black toner 4-(1) was produced in the same manner as in the production process of toner 2 except for changing the pigment to carbon black. The thus-obtained black toner 4-(1) had a number average particle diameter of 6.8 μm and a sphericity of 0.973. A work function of the toner 4-(1) was detected to be 5.48 eV.

A toner 4-(2) was obtained in the same manner except for using the hydrophobic alumina 2 by gas phase method in place of the hydrophobic alumina 1 by gas phase method. A work function of the toner 4-(2) detected in the same manner was 5.48 eV.

For comparison, a toner 4-(3) was obtained in the same manner except for using the hydrophilic alumina 1 by gas phase method in place of the hydrophobic alumina 1 by gas phase method. A work function of the toner 4-(3) detected in the same manner was 5.47 eV.

Production of Toner 5

After uniformly mixing 100 parts by weight of a 50:50 mixture (Hymer-ES-803; product of Sanyo Kasei Co., Ltd.; glass transition temperature: 61° C.) of a polycondensation polyester of aromatic dicarboxylic acid and alkylene-etherified bisphenol A and a partially crosslinked compound of the polycondensation polyester by polyvalent metal, 5 parts by weight of pigment blue 15:1 which is a cyan pigment, 3 parts by weight of carnauba wax which is a release agent having a meting point of 80° C. to 86° C., and 4 parts by weight of a salicylic acid metal complex E-81 (product of Orient Chemical Industries, Ltd.) which is a charge controlling agent using a henschel mixer, the mixture was kneaded by a biaxial extruder having an inner temperature of 130° C., followed by cooling.

Then, the cooled mixture was roughly pulverized into 2 mm square pieces, and 100 parts by weight of the roughly pulverized substance was thrown into a mixture solution of 150 parts by weight of toluene and 100 pars by weight of ethyl acetate and stirred to obtain a uniformly mixed oil phase dispersion liquid. A viscosity of this dispersion liquid at 25° C. was 63 mP·s.

Then, 5 parts by weight of a fine powder of tricalcium phosphate (the fine powder was obtained by pulverization by a ball mill, and it was confirmed that particles having a particle diameter of 3 μm or more is not included in the fine powder) and 5 parts of a 1 wt % solution of dodecylbenzene sodium sulfonate were added to 1,100 parts by weight of ion exchange water followed by stirring to obtain a water phase uniformly mixed dispersion liquid.

Particle formation was performed in such a manner that the above-described solution was poured into a container shown in FIG. 2A provided with an oily liquid injection member having a porous glass (fine pore diameter: 3 μm; product of SPG Technology, Co., Ltd.) on its side, a stirring blade, a supersonic wave element, followed by stirring at a rate of 10 revolutions per minute so as to prevent coalescence of emulsion fine particles to be formed at the same time with causing vibration by applying a voltage to supply a current of 100 μA to a supersonic wave homogenizer (product of Nihon Seiki Seisakusho, Co., Ltd.; Model US-300T, Output: 300 W; diameter of transducer: 26 mm; frequency: 20 kHz) fixed on the container. Then, the above-described oily liquid was introduced (from the direction indicated by the arrow in FIG. 2) at a pressure of $14.7\times10^4$ Pa into a pipe directly connected to the oily liquid injection member to inject the oily liquid into the aqueous liquid from pores of the porous glass 1. The stirring was continued for 10 minutes after the oily liquid injection.

After that, the thus-formed emulsion was withdrawn from a bottom of the container shown in FIG. 2 to be placed in a separate stirring bath. The emulsion was then stirred at 55° C. to remove the organic solvent contained therein. After that, the emulsion was washed with 5N hydrochloric acid, followed by repetitive water washing and filtration and then drying, thereby obtaining cyan toner mother particles.

An average particle diameter and a sphericity of the thus-obtained cyan toner mother particles were measured by using the flow particle image analyzer FPIA2100, product of Sysmex Corporation. The number average particle diameter was 6.5 μm, and the sphericity was 0.980. A work function of the cyan toner mother particles was 5.23 eV.

To this toner mother particles, 0.5 wt % of the hydrophobic negatively chargeable silica by gas phase method (BET specific surface area: 213 $m^2/g$), 0.3 wt % of the hydrophobic negatively chargeable silica by gas phase method (BET specific surface area: 48 $m^2/g$), and 0.2 wt % of the hydrophobic negatively chargeable monodisperse spherical silica (BET specific surface area: 11 $m^2/g$) were added and mixed, followed by adding to the mixture 0.5 wt % of the hydrophobic rutile anatase type titanium oxide (BET specific surface area: 124 $m^2/g$) and 0.2 wt % of the hydrophobic alumina 3 by gas phase method to obtain a toner 5-(1). A work function of the toner 5-(1) detected in the same manner was 5.24 eV.

For comparison, a toner 5-(2) was obtained in the same manner except for using the hydrophilic alumina 2 by gas phase method in place of the hydrophobic alumina 3 by gas phase method. A work function of the toner 5-(2) detected in the same manner was 5.23 eV.

Production of Toner 6

Toner mother particles were obtained in the same manner except for using carmine 6B which is a magenta pigment in place of the cyan pigment. The thus-obtained toner mother particles had a number average particle diameter of 6.6 μm and a sphericity of 0.980. A work function of this toner mother particles was detected to be 5.70 eV. Also, a magenta toner 6-(1) was produced in the same manner as in the production process of the toner 5 by performing the external addition treatment on this toner mother particles. A work function of the magenta toner 6-(1) was detected to be 5.71 eV.

For comparison, a toner 6-(2) was obtained in the same manner except for using the hydrophilic alumina 2 by gas phase method in place of the hydrophobic alumina 3 by gas phase method. A work function of the toner 6-(2) detected in the same manner was 5.70 eV.

Production of Toner 7

Toner mother particles were obtained in the same manner as in the production process of the toner 5 except for using pigment yellow 180 which is a yellow pigment in place of the cyan pigment. The thus-obtained toner mother particles had a number average particle diameter of 6.5 μm and a sphericity of 0.981. A work function of this toner mother particles was detected to be 5.51 eV. Also, a magenta toner 6-(1) was produced in the same manner as in the production process of the toner 5 by performing the external addition treatment on this toner mother particles. A work function of the magenta toner 7-(1) was detected to be 5.50 eV.

For comparison, a toner 7-(2) was obtained in the same manner except for using the hydrophilic alumina 2 by gas phase method in place of the hydrophobic alumina 3 by gas phase method. A work function of the toner 7-(2) detected in the same manner was 5.51 eV.

Production of Toner 8

Toner mother particles were obtained in the same manner as in the production process of the toner 5 except for using carbon black in place of the cyan pigment. The thus-obtained toner mother particles had a number average particle diameter of 6.6 μm and a sphericity of 0.980. A work function of this toner mother particles was detected to be 5.40 eV. Also, a magenta toner 8-(1) was produced in the same manner as in the production process of the toner 5 by performing the external addition treatment on this toner mother particles. A work function of the magenta toner 8-(1) was detected to be 5.39 eV.

For comparison, a toner 8-(2) was obtained in the same manner except for using the hydrophilic alumina 2 by gas phase method in place of the hydrophobic alumina 3 by gas phase method. A work function of the toner 8-(2) detected in the same manner was 5.40 eV.

Example 1

The organic photoreceptor 1, the development roller, and the regulation blade described above were incorporated into the 4 cycle color printer of contactless rotary development system shown in FIG. 7 to perform printing test.

In the printing test, a case wherein the cleaning blade for the organic photoreceptor was removed to incorporate the intermediate transfer belt 1 and a case wherein the cleaning blade for the organic photoreceptor was removed to incorporate the intermediate transfer medium 2 were examined and compared by using the toner 1-(1), 1-(2), and 1-(3) as a comparison. A peripheral velocity of the organic photoreceptor was 180 mm/s, and a peripheral velocity of the development roller was set to 1.3 times that of the organic photoreceptor. A peripheral velocity difference between the organic photoreceptor and the intermediate transfer belt was so set as to keep the peripheral velocity of the intermediate transfer belt faster than that of the organic photoreceptor by 3%. The peripheral velocity difference was set to 3% since dust generation on a transferred image was confirmed in a preliminary experiment with the peripheral velocity difference of more than 3%. A transfer voltage at a primary transfer member was +450 V, and the regulation condition of a toner regulation blade was such that a toner conveying amount was adjusted to be 0.38 $mg/cm^2$. The printing test was performed under such conditions that a frequency of AC superimposed on a DC development bias (−200 V) was 2.5 kHz and P-P voltage was 1400 V. A development gap was set to 210 μm (adjusted by using a gap roller). Under the above-described conditions, 1,000 copies of a character manuscript equivalent to a cyan color 5% color manuscript were continuously printed.

After the printing, the toner and the external additive filmed on the organic photoreceptor were measured by a tape transfer method. The tape transfer method was conducted in such a manner that a tape (a mending tape manufactured by Sumitomo 3M, Ltd.) was stacked on the toner on the organic photoreceptor to transfer the toner to the tape, and a weight of the tape was measured to determine a weight of the filmed toner from a difference between the weights of the tape before and after the stacking. The deposits collected by the tape transfer method were analyzed by a fluorescence analysis method, and it was confirmed that almost all of the deposits was alumina fine particles. A toner transfer efficiency was 99.2%.

Result of the test is shown below.

TABLE 2

| Toner | Work function of alumina (eV) | Intermediate transfer belt 1 (5.19 eV) (mg/cm$^2$) | Intermediate transfer belt 2 (5.69 eV) (mg/cm$^2$) |
|---|---|---|---|
| Toner 1-(1) | 5.38 | 0.006 | 0.026 |
| Toner 1-(2) | 5.36 | 0.006 | 0.026 |
| Toner 1-(3) | 5.29 | 0.023 | 0.035 |

As is apparent from Table 2, the amount of filming on the organic photoreceptor by the toner and the external additive particles was reduced when the work function of the alumina fine particles is larger than that of the intermediate transfer belt and when the alumina fine particles had been subjected to the silicon oil treatment. It is considered that, by keeping the work function of the alumina fine particles larger than that of the intermediate transfer belt, the charge characteristic of the hydrophobic alumina fine particles, which is originally a weakly positive, is turned into the negative charge characteristic when electrons immigrate from the intermediate transfer belt to the alumina fine particles at the time of contact of the alumina fine particles with the intermediate transfer belt, and, therefore, the alumina fine particles tend to immigrate on the intermediate transfer belt thanks to the polishing effect of the alumina fine particles and the positive transfer voltage applied on the intermediate transfer belt.

Example 2

2,000 copies of an image of N-2A "Café terrier" which is a standard image data in accordance with JIS X 9201-1995 were printed by using the produced toners and the color printer used in Example 1 and shown in FIG. 7. After that, the toners and the external additive filmed on the organic photoreceptor were measured by the tape transfer method. Results of the measurements are shown in Table 3.

TABLE 3

| Toner | Work function of alumina (eV) | Intermediate transfer belt 1 (5.19 eV) (mg/cm$^2$) | Intermediate transfer belt 2 (5.69 eV) (mg/cm$^2$) |
|---|---|---|---|
| Toner 1-(1) to 4-(1) | 5.38 | 0.009 | 0.031 |
| Toner 1-(2) to 4-(2) | 5.36 | 0.009 | 0.032 |
| Toner 1-(3) to 4-(3) | 5.29 | 0.027 | 0.041 |

The toner 1-(1) to 4-(1) means the toner 1-(1), 2-(1), 3-(1), and 4-(1). The same applied to the other toners.

As is apparent from Table 3, the amount of filming on the organic photoreceptor by the toner and the external additive particles was reduced when the work function of the alumina fine particles is larger than that of the intermediate transfer belt and when the alumina fine particles had been subjected to the silicon oil treatment. It is thus proved that it is advantageous to keep the work function of alumina fine particles larger than that of the intermediate transfer belt as well as to subject the alumina fine particle to the silicon oil treatment in the image forming apparatus of the cleanerless method which does not have any cleaning blade on the organic photoreceptor.

The color printer after printing the 2,000 copies was left for 12 hours in an environmental test laboratory which was kept at 25° C. and at a relative humidity of 65%, and then the image of N-2A "Café terrier" was continuously printed again with the intermediate belt being mounted. The image obtained by the image forming apparatus on which the intermediate transfer belt 1 and the toner obtained by using the hydrophobic alumina particles 1 and 2 as the external additives were mounted was free from blurring, but the image obtained by the image forming apparatus on which the intermediate transfer belt 1 or 2 and the toner obtained by using the hydrophilic alumina particles as the external additive were mounted was blurred, and the blurring in the image obtained by the image forming apparatus on which the intermediate transfer belt 2 was mounted was relatively more prominent. It is considered that the blurring was caused by water absorption by the alumina external additive filmed on the organic photoreceptor, which led to deteriorations in filtering effect and surface resistance.

Example 3

A printing test was conducted by using the organic photoreceptor 2 and a color printer of the contactless tandem development system shown in FIG. 8 using the intermediate transfer belt, on which the above-described development roller and regulation blade are mounted. The toners 5-(1) and toner 5-(2) were used in this printing test.

For the image formation, a circumferential speed of the organic photoreceptor was set to 1.5 mm/s, and a circumferential speed of the development roller was set to 1.5 times that of the organic photoreceptor. A difference between the circumferential speeds of the organic photoreceptor and the intermediate transfer belt was such that the intermediate transfer belt is faster than the organic photoreceptor by 2.5%. The peripheral velocity difference was set to 2.5% since dust generation on a transferred image was confirmed in a preliminary experiment with the peripheral velocity difference of more than 3%. A toner conveying amount on the development roller was adjusted to 0.4 mg/cm$^2$.

The conditions were such that a dark potential of the organic photoreceptor was −600 V; a light potential of the organic photoreceptor was −80 V; a development bias was 200 V; a development gap was 210 μm (the gap was adjusted by using a gap roller); AC to be superimposed on the DC development bias of −200 V was at a frequency of 2.5 kHz; a P-P voltage of 1,400 V; and the development roller and the supply roller were identical in potentiality. The power for the primary transfer member was set to a constant voltage of +450 V, and a DC constant current was supplied to the secondary transfer member.

1,000 copies of a character manuscript corresponding to a cyan color 5% color manuscript were printed continuously. After that the toner and the external additive filmed on the organic photoreceptor were measured by the tape transfer method. Results of the measurements are shown in Table 4.

TABLE 4

| Toner | Work function of alumina (eV) | Intermediate transfer belt 1 (5.19 eV) ($mg/cm^2$) | Intermediate transfer belt 2 (5.69 eV) ($mg/cm^2$) |
|---|---|---|---|
| Toner 5-(1) | 5.40 | 0.005 | 0.021 |
| Toner 5-(2) | 5.27 | 0.022 | 0.032 |

As is apparent from Table 2, the amount of filming on the organic photoreceptor by the toner and the external additive particles was reduced when the work function of the alumina fine particles is larger than that of the intermediate transfer belt and when the alumina fine particles had been subjected to the silicon oil treatment. It is considered that, by keeping the work function of the alumina fine particles larger than that of the intermediate transfer belt, the charge characteristic of the hydrophobic alumina fine particles, which is originally a weakly positive, is turned into the negative charge characteristic when electrons immigrate from the intermediate transfer belt to the alumina fine particles at the time of contact of the alumina fine particles with the intermediate transfer belt, and, therefore, the alumina fine particles tend to immigrate on the intermediate transfer belt thanks to the polishing effect of the alumina fine particles and the positive transfer voltage applied on the intermediate transfer belt.

Example 4

2,000 copies of the image of N-2A "Café terrier" which is a standard image data in accordance with JIS X 9201-1995 were printed by using the produced toners and the color printer shown in FIG. 8 in the same manner as in Example 3. Each of the color toners was adjusted by way of a regulation condition of the toner regulation blade, i.e. by keeping a toner conveying amount of the development roller at from 0.40 $mg/cm^2$ to 0.43 $mg/cm^2$.

After that, the toners and the external additive filmed on the organic photoreceptor were measured by the tape transfer method. Results of the measurements are shown in Table 5.

TABLE 5

| Toner | Work function of alumina (eV) | Intermediate transfer belt 1 (5.19 eV) ($mg/cm^2$) | Intermediate transfer belt 2 (5.69 eV) ($mg/cm^2$) |
|---|---|---|---|
| Toner 5-(1) to 8-(1) | 5.38 | 0.009 | 0.031 |
| Toner 5-(2) to 8-(2) | 5.36 | 0.009 | 0.032 |

As is apparent from Table 5, the amount of filming on the organic photoreceptor by the toner and the additionally added agent particles was reduced when the work function of the alumina fine particles is larger than that of the intermediate transfer belt and when the alumina fine particles had been subjected to the silicon oil treatment. It is thus proved that it is advantageous to keep the work function of alumina fine particles larger than that of the intermediate transfer belt as well as to subject the alumina fine particle to the silicon oil treatment in the image forming apparatus of the cleanerless method which does not have any cleaning blade on the organic photoreceptor.

In the same manner as in Example 2, the color printer after printing the 2,000 copies was left for 12 hours in an environmental test laboratory which was kept at 25° C. and at a relative humidity of 65%, and then the image of N-2A "Café terrier" was continuously printed again with the intermediate belt being mounted. The image obtained by the image forming apparatus on which the intermediate transfer belt 1 and the toner obtained by using the hydrophobic alumina particles 3 as the externally added agent were mounted was free from blurring, but the image obtained by the image forming apparatus on which the intermediate transfer belt 1 or 2 and the toner obtained by using the hydrophilic alumina particles 2 as the externally added agent were mounted was blurred, and the blurring in the image obtained by the image forming apparatus on which the intermediate transfer belt 2 was mounted was relatively more prominent. It is considered that the blurring was caused by water absorption by the alumina additionally added agent filmed on the organic photoreceptor, which led to deteriorations in filtering effect and surface resistance.

As described above, the image forming apparatus of this invention is downsized by producing a latent image carrier without a cleaner and capable of reducing deposition on a surface of the latent image carrier as well as of preventing filming otherwise caused by the deposition on latent image carrier.

While the present invention has been described in detail and with reference to specific embodiments thereof, it will be apparent to one skilled in the art that various changes and modifications can be made therein without departing from the spirit and scope thereof.

The present application is based on Japanese Patent Application No. 2004-189615 filed on Jun. 28, 2004, and the contents thereof are incorporated herein by reference.

What is claimed is:

1. An image forming apparatus comprising:

a negatively chargeable spherical toner;

a latent image carrier;

a charging member for charging a surface of the latent image carrier uniformly without contacting the latent image carrier;

a cleanerless electrostatic latent image forming member for forming an electrostatic latent image on the surface of the latent image carrier;

a developing member for developing the electrostatic latent image, without contacting the latent image carrier, by using the negatively chargeable spherical toner so as to form a toner image on the latent image carrier; and an intermediate transfer medium to which the toner image is transferred, wherein the negatively chargeable spherical toner comprises: a toner mother particle comprising a binder resin and a colorant; and a hydrophobic alumina particle as an external additive, wherein the hydrophobic alumina particle has a work function ($\Phi_{A1}$) larger than a work function ($\Phi_{TM}$) of a surface of the intermediate transfer medium.

2. The image forming apparatus according to claim 1, wherein the hydrophobic alumina particle is subjected to a silicon oil treatment.

3. The image forming apparatus according to claim 2, wherein the silicon oil treatment is subjected by a ratio of 0.1 to 10% by weight.

4. The image forming apparatus according to claim 1, wherein the work function ($\Phi_{A1}$) of the hydrophobic alumina particle is from 5.1 to 5.7 eV and the work function ($\Phi_{TM}$) of the surface of the intermediate transfer medium is from 4.9 to 5.5 eV, and the difference between the work function of the hydrophobic alumina particle and that of the surface of the intermediate transfer medium is at least 0.2 eV.

5. The image forming apparatus according to claim 1, wherein the intermediate transfer medium is an electronic conductive intermediate transfer belt.

6. The image forming apparatus according to claim 5, wherein the intermediate transfer belt has a circumferential speed of 1.0 to 2.5 times as large as that of the latent image carrier.

7. The image forming apparatus according to claim 1, wherein a work function ($\Phi_t$) of the negatively chargeable spherical toner, a work function ($\Phi_{OPC}$) of the surface of the latent image carrier, and the work function ($\Phi_{TM}$) of the surface of the intermediate transfer medium satisfy a relationship of $\Phi_t > \Phi_{OPC} > \Phi_{TM}$.

8. The image forming apparatus according to claim 7, wherein the work function ($\Phi_t$) of the negatively chargeable spherical toner is from 5.4 to 5.9 eV, the work function ($\Phi_{OPC}$) of the surface of the latent image carrier is from 5.2 to 5.6 eV, and the work function ($\Phi_{TM}$) of the surface of the intermediate transfer medium is from 4.9 to 5.5 eV, wherein the difference between the work function of the negatively chargeable spherical toner and that of the surface of the latent image carrier is at least 0.2 eV, and the difference between the work function of the surface of the latent image carrier and that of the surface of the intermediate transfer medium is at least 0.2 eV.

9. The image forming apparatus according to claim 1, wherein a sphericity of the negatively chargeable spherical toner is from 0.96 to 0.99 as a sphericity measured by a flow type particle image analyzer.

10. The image forming apparatus according to claim 1, wherein the negatively chargeable spherical toner is a monocomponent nonmagnetic toner formed by a solution suspension method.

11. A negatively chargeable spherical toner comprising:

a toner mother particle comprising a binder resin and a colorant; and a hydrophobic alumina particle as an external additive, wherein the hydrophobic alumina particle has a work function larger than a work function of a surface of an intermediate transfer medium.

12. The negatively chargeable spherical toner according to claim 11, wherein the hydrophobic alumina particle is subjected to a silicon oil treatment.

13. The negatively chargeable spherical toner according to claim 12, wherein the silicon oil treatment is subjected by a ratio of 0.1 to 10% by weight.

14. The negatively chargeable spherical toner according to claim 11, wherein the work function of the hydrophobic alumina particle is from 5.1 to 5.7 eV.

15. The negatively chargeable spherical toner according to claim 11, wherein a sphericity of the negatively chargeable spherical toner is from 0.96 to 0.99 as a sphericity measured by a flow type particle image analyzer.

16. The negatively chargeable spherical toner according to claim 11, wherein the negatively chargeable spherical toner is a monocomponent nonmagnetic toner formed by a solution suspension method.

* * * * *